US011292105B2

(12) United States Patent
Lazenby et al.

(10) Patent No.: US 11,292,105 B2
(45) Date of Patent: Apr. 5, 2022

(54) MULTIPURPOSE TOOL HAVING ACCESSIBLE TOOL MEMBERS

(71) Applicant: Leatherman Tool Group, Inc., Portland, OR (US)

(72) Inventors: Adam Lazenby, Lake Oswego, OR (US); Benjamin C. Rivera, Lake Oswego, OR (US); Jeffrey B. Castro, Portland, OR (US)

(73) Assignee: LEATHERMAN TOOL GROUP, INC., Portland, OR (US)

( * ) Notice: Subject to any disclaimer, the term of this patent is extended or adjusted under 35 U.S.C. 154(b) by 0 days.

(21) Appl. No.: 15/170,456

(22) Filed: Jun. 1, 2016

(65) Prior Publication Data

US 2017/0348830 A1 Dec. 7, 2017

(51) Int. Cl.

| | |
|---|---|
| ***B25B 7/22*** | (2006.01) |
| ***B25F 1/04*** | (2006.01) |
| ***B26B 17/00*** | (2006.01) |

(52) U.S. Cl.

CPC ..... *B25B 7/22* (2013.01); *B25F 1/04* (2013.01); *B26B 17/00* (2013.01)

(58) Field of Classification Search

CPC .... B25F 1/00; B25F 1/003; B25F 1/04; B25B 7/22

See application file for complete search history.

(56) References Cited

U.S. PATENT DOCUMENTS

| | | | | |
|---|---|---|---|---|
| 4,238,862 | A * | 12/1980 | Leatherman | B25B 7/22 7/128 |
| 5,060,379 | A | 10/1991 | Neely | |
| 5,212,844 | A | 5/1993 | Sessions et al. | |
| 5,765,247 | A | 6/1998 | Seber et al. | |
| 6,088,861 | A | 7/2000 | Sessions et al. | |
| 6,092,444 | A | 7/2000 | Hsiao | |

(Continued)

FOREIGN PATENT DOCUMENTS

| | | | |
|---|---|---|---|
| CN | 103906603 | A | 12/1980 |
| CN | 1303762 | A | 7/2001 |

(Continued)

OTHER PUBLICATIONS

Examination Report No. 1 for Standard Patent Application No. 2017203480, dated Feb. 2, 2018, 9 pages.

(Continued)

*Primary Examiner* — Joel D Crandall
(74) *Attorney, Agent, or Firm* — Alston & Bird LLP

(57) ABSTRACT

A multipurpose tool and components thereof are provided in order to facilitate utilization of the multipurpose tool by users in a wide variety of applications. A multipurpose tool may include first and second handles configured for relative movement between a closed position and an open position. The multipurpose tool may also include a plurality of tool members. One or more of the plurality of tool members are carried by and foldable into the first handle. Similarly, one or more of the plurality of tool members are carried by and foldable into the second handle. The multipurpose tool may further include a first magnet carried by the first handle. The first magnet is configured to exert a magnetic force that biases the first and second handles into the closed position.

28 Claims, 14 Drawing Sheets

(56) References Cited

U.S. PATENT DOCUMENTS

| | | | | |
|---|---|---|---|---|
| 6,185,771 | B1 | 2/2001 | Trusty et al. | |
| 6,405,395 | B1 | 6/2002 | Poehlmann et al. | |
| 6,564,678 | B1 | 5/2003 | Wang | |
| 6,622,327 | B1 | 9/2003 | Rivera | |
| 6,983,505 | B2 | 1/2006 | McIntosh et al. | |
| 7,146,668 | B2 | 12/2006 | Rivera | |
| 7,249,390 | B2 | 7/2007 | Yale et al. | |
| 7,399,101 | B2 * | 7/2008 | Clausen | B25G 1/102 362/119 |
| 7,497,015 | B2 | 3/2009 | Tsuda | |
| 7,926,136 | B2 | 4/2011 | Yale et al. | |
| 8,328,170 | B2 * | 12/2012 | Wasinger | B25B 7/02 269/216 |
| 9,636,805 | B2 | 5/2017 | Wang | |
| 9,682,469 | B2 | 6/2017 | Heise | |
| 9,751,201 | B2 | 9/2017 | King, Jr. et al. | |
| 10,265,841 | B2 | 4/2019 | Rauwerdink et al. | |
| 2002/0023302 | A1 * | 2/2002 | Montague | B23D 29/002 7/128 |
| 2002/0083530 | A1 * | 7/2002 | Rivera | B25F 1/003 7/128 |
| 2002/0108182 | A1 * | 8/2002 | Rivera | B25F 1/003 7/128 |
| 2004/0237207 | A1 | 12/2004 | Rivera | |
| 2005/0150333 | A1 * | 7/2005 | Rivera | B25B 15/001 81/450 |
| 2005/0217118 | A1 | 10/2005 | Mah | |
| 2007/0019400 | A1 | 1/2007 | Clausen et al. | |
| 2007/0131069 | A1 * | 6/2007 | Rivera | B25F 1/003 81/450 |
| 2007/0193036 | A1 * | 8/2007 | Carlson | B26B 1/04 30/158 |
| 2008/0236210 | A1 * | 10/2008 | Frazer | B25F 1/003 70/61 |
| 2013/0025071 | A1 * | 1/2013 | Keng | B25G 1/08 7/118 |
| 2014/0041491 | A1 | 2/2014 | Ying et al. | |
| 2015/0283678 | A1 * | 10/2015 | Hangen | B24D 15/08 451/552 |
| 2016/0288309 | A1 | 10/2016 | Rauwerdink et al. | |
| 2017/0348830 | A1 | 12/2017 | Lazenby et al. | |

FOREIGN PATENT DOCUMENTS

| | | | |
|---|---|---|---|
| CN | 1644326 | A | 7/2005 |
| CN | 107427996 | | 12/2017 |
| DE | 912 080 | C | 5/1954 |
| EP | 1 116 557 | A2 | 7/2001 |
| EP | 1213100 | | 11/2006 |
| EP | 1 857 231 | A1 | 11/2007 |
| EP | 1354668 | | 5/2008 |
| EP | 2465645 | A2 | 12/2011 |
| JP | 2002/500964 | | 1/2002 |
| JP | 2007/000643 | A | 1/2007 |
| JP | 2009/216168 | A | 9/2009 |
| JP | 2011/148080 | | 8/2011 |
| JP | 2017/213677 | A | 12/2017 |
| TW | M421210 | | 1/2012 |
| WO | WO 9937446 | A1 | 7/1999 |

OTHER PUBLICATIONS

Notice of Acceptance from South African Patent No. 2017/03750, dated Feb. 6, 2018, 1 page.
European Search Report for European Application No. 17172956.9, dated Apr. 20, 2018, 13 pages.
Partial European Search Report from European Patent Application No. 17172956.9 dated Jan. 22, 2018, 11 pages.
Office Action for Japanese Application No. 2017-108945 dated Jun. 27, 2018, 5 pages.
Office Action for Japanese Application No. 2017-108945 dated Apr. 1, 2019, 5 pages.
Office Action for Australian Application No. 2017203480 dated Jan. 21, 2019.
Office Action for Chinese Application No. 201710404949.1 dated Jan. 6, 2020.
European Search Report for European Application No. 19204143.2, dated Nov. 7, 2019, 9 pages.
Office Action for Japanese Application No. 2017-108945 dated Nov. 25, 2019.
Office Action for Chinese Application No. 201710404949.1 dated Nov. 27, 2020.
Office Action for Korean Application No. 10-2019-0060275 dated Nov. 11, 2020.
Extended European Search Report for Application No. 19171817.0 dated Feb. 19, 2020.
Office Action for Australian Application No. 2019202972 dated Apr. 8, 2020.
Office Action for Canadian Application No. 3,042,200 dated Aug. 4, 2020.
Office Action for Japanese Application No. 2019-107936 dated Aug. 31, 2020.
Office Action for Taiwan Application No. 108115673 dated Dec. 9, 2019.
4th Office Action for China Application No. 2017104049491 dated Sep. 6, 2021 with English translation (19 pages).
Office Action for Japanese Patent Application No. 2020-072803 dated Jun. 17, 2021 with English translation (3 pages).
3rd Office Action for China Application No. 2017104049491 dated May 31, 2021 with English translation (9 pages).
Extended European Search Report for Application No. 19204143.2 dated Nov. 18, 2019.
Office Action for Australian Application No. 2019200615 dated Mar. 25, 2020.

* cited by examiner

MULTIPURPOSE TOOL HAVING ACCESSIBLE TOOL MEMBERS

TECHNOLOGICAL FIELD

An example embodiment relates generally to a multipurpose tool and, more particularly, to a multipurpose tool having features to facilitate usage of the multipurpose tool by users in a variety of different applications.

BACKGROUND

Multipurpose tools are widely popular for their utility in a number of different applications. A multipurpose tool includes a number of tool members carried by a common frame. A multipurpose tool may include different combinations of tool members depending upon its intended application. For example, multipurpose tools that are designed for a more universal or generic application can include pliers, a wire cutter, a bit driver, one or more knife blades, a saw blade or the like. Other multipurpose tools are designed to service more specific applications or niche markets and correspondingly include tool members that are useful for the intended application. For example, multipurpose tools may be specifically designed for automobile repair, hunting, fishing or other outdoor applications, gardening, snow skiing, snowboarding, bicycling or other recreational activities as well as military and emergency medical applications, to name a few.

One reason for the popularity of multipurpose tools is the capability provided by a multipurpose tool to provide a wide range of functionality with a single tool, thereby reducing the need to carry a number of different tools to perform the same functions. For example, a single multipurpose tool may be carried instead of a pair of pliers, one or more screwdrivers, a knife and a bottle opener. As such, the burden placed upon the user is reduced since the user need only carry a single multipurpose tool.

As multipurpose tools are frequently carried by users in the field, it is desirable for the multipurpose tools to be relatively small and lightweight, while remaining rugged so as resist damage. In order to reduce the overall size of a multipurpose tool, some multipurpose tools have been designed to be foldable. In this regard, foldable multipurpose tools are designed to be alternately folded into a closed position and an open position. Generally, the closed position is more compact with the multipurpose tool frequently being carried in the closed position. Conversely, while the open position is generally less compact than the closed position, the open position generally allows the deployment of one or more of the tool members that are stowed and relatively inaccessible when the multipurpose tool is in the closed position.

For example, a multipurpose tool may include pliers having a pair of jaws connected to respective handles. In the open position, the pliers are deployed and are capable of being actuated by moving the handles toward and away from one another. In the closed position, the handles are folded about the pliers such that the pliers are no longer functional and are instead, positioned within the handles. In the closed position, however, the multipurpose tool is more compact with the form factor generally defined by the proximal relationship with the handles.

In addition to the pliers that are deployed as the handles are transitioned from the closed position to the open position, the handles of the multipurpose tool also generally house one or more tool members. By storing the tool members within the handles when the tool members are not in use, the form factor of the multipurpose tool may be relatively small in comparison to the number of tool members carried by the multipurpose tool. Thus, the multipurpose tool may have substantial utility and versatility, albeit in a relatively small tool. To access a tool member that is stored within a handle, a user may engage the tool member, such as with their fingernail, and may unfold the tool member such that the tool member is operational.

BRIEF SUMMARY

Notwithstanding the versatility and functionality provided by a multipurpose tool, a multipurpose tool and components thereof are provided in accordance with an example embodiment in order to facilitate utilization of the multipurpose tool by users in a wide variety of applications. For example, the multipurpose tool of an example embodiment is configured to facilitate the transition of the multipurpose tool from a closed position to an open position such that a user can more readily open the tool with one hand and in a manner that is consistent and repeatable over the lifetime of the tool. Further, the multipurpose tool of an example embodiment is configured to improve upon the manner in which individual tool members are folded out of the handle and locked in an operational position, thereby improving the accessibility and utilization of the tool members. Additionally, the multipurpose tool of an example embodiment has a handle that is configured to permit the length of at least some of the tool members to be increased relative to the length of the handle, thereby further improving the performance offered by the tool members without an increase in the form factor of the multipurpose tool. As these examples demonstrate, the multipurpose tool of an example embodiment is configured to offer both improved performance characteristics, as well as improved versatility and ruggedness.

In an example embodiment, a multipurpose tool is provided that includes a handle defining a channel and a plurality of tool members carried by and foldable into the channel defined by the handle. The plurality of tool members define a notch extending in a lateral direction extending between the opposed sidewalls of the handle. The notch is exposed in an instance in which the tool members are folded into the channel. As such, the notch is configured to be engaged by a user in order to at least partially rotatably open one or more of the tool members relative to the handle.

In an embodiment in which the plurality of tool members include first and second tool members, each tool member may include a cam member. In this embodiment, the multipurpose tool further includes a cam follower configured to engage the cam member of each of the first and second tool members during rotation of the first and second tool members relative to the first handle. The cam member of the first tool member may be different than the cam member of the second tool member such that the cam follower engages the cam member of the first tool member during opening of the first tool member upon rotation of the first tool member through a first incidence angle relative to the first handle and the cam follower engages the cam member of the second tool member during opening of the second tool member following rotation of the second tool member through a second incidence angle, different than the first incidence angle, relative to the first handle. In this regard, the cam follower may engage the cam member of the first tool member immediately upon opening of the first tool member and the cam follower does not engage the cam member of the second tool member immediately upon opening of the second tool member but only engages the cam member of the second tool member during opening of the second tool member after the second tool member has rotated through the second incidence angle. The second incidence angle may be greater than zero. The second tool member defines the notch.

The multipurpose tool of an example embodiment also includes a magnet carried by the handle. The magnet of this embodiment is positioned relative to the tool members such that the magnet establishes a magnetic force in a path that extends through one or more of the tool members so as to bias the one or more tool members into a closed position in which the one or more tool members are folded into the channel. In an embodiment in which the plurality of tool members include first and second tool members, the multipurpose tool may also include a non-rotating spacer positioned between the first and second tool members.

In an example embodiment, a multipurpose tool is provided that includes first and second handles configured for relative movement between a closed position and an open position. The multipurpose tool also includes a plurality of tool members. One or more of the plurality of tool members are carried by and foldable into the first handle. Similarly, one or more of the plurality of tool members are carried by and foldable into the second handle. The multipurpose tool further includes a first magnet carried by the first handle. The first magnet is configured to exert a magnetic force that biases the first and second handles into the closed position.

A multipurpose tool of an example embodiment also includes a second magnet carried by the second handle and aligned with the first magnet in an instance in which the first and second handles are in the closed position. In an example embodiment, the first magnet is positioned relative to the tool members such that the first magnet establishes the magnetic force in a path that extends through one or more of the tool members so as to bias the one or more tool members into a closed position in which the one or more tool members are folded into a respective handle.

The first handle includes an axle upon which a plurality of tool members are rotatably mounted. The plurality of tool members include first and second tool members, each of which includes a cam member. The multipurpose tool of this example embodiment also includes a cam follower configured to engage the cam member of each of the first and second tool members during rotation of the first and second tool members relative to the first handle. In an example embodiment, the cam member of the first tool member is different than the cam member of the second tool member. As such, the cam follower engages the cam member of the first tool member during opening of the first tool member upon rotation of the first tool member through a first incidence angle relative to the first handle. In this regard, the cam follower engages the cam member of the second tool member during the opening of the second tool member following rotation of the second tool member through a second incidence angle, different than the first incidence angle, relative to the first handle. In an example embodiment, the cam follower engages the cam member of the first tool member immediately upon opening of the first tool member. Conversely, the cam follower does not engage the cam member of the second tool member immediately upon opening of the second tool member, but only engages the cam member of the second tool member during opening of the second tool member after the second tool member has rotated through the second incidence angle, which is greater than zero.

The multipurpose tool of an example embodiment also includes first and second jaws rotatably connected to the first and second handles, respectively. Each jaw includes a wall member. The multipurpose tool of this example embodiment also includes first and second spring members configured to engage the wall members of the first and second jaws, respectively. The wall member of each jaw has a thickness that varies such that the first and second spring members engage thicker portions of the wall members of the first and second jaws, respectively, as the first and second handles are rotated from the closed position to the open position. The first and second handles each include opposed sidewalls. In an example embodiment, the first and second spring members are configured to provide a spring force to the wall members of the first and second jaws, respectively, that is directed through one of the sidewalls. In an example embodiment, a respective tool member defines a slot that includes an enlarged portion. The respective tool member is configured to alternately receive a knife blade within the slot or a screwdriver within the enlarged portion of the slot.

In another example embodiment, a multipurpose tool is provided that includes first and second handles configured for relative movement between a closed position and an open position. The multipurpose tool also includes a plurality of tool members. One or more of the plurality of tool members are carried by and foldable into the first handle. Similarly, one or more of the plurality of tool members are carried by and foldable into the second handle. The multipurpose tool further includes a first magnet carried by the first handle and positioned relative to the tool members such that the first magnet establishes a magnetic force in a path that extends through at least one tool member carried by the first handle. The magnetic force therefore biases the at least one tool member toward a closed position in which the at least one tool member is folded into the first handle. In an example embodiment, the multipurpose tool also includes a second magnet carried by the second handle and aligned with the first magnet in an instance in which the first and second handles are in the closed position. The first and second magnets of this example embodiment are configured to bias the first and second handles into the closed position.

In an example embodiment, the first handle includes an axle upon which the plurality of tool members are rotatably mounted. The plurality of tool members include first and second tool members, each of which includes a cam member. The multipurpose tool of this example embodiment also includes a cam follower configured to engage the cam member of each of the first and second tool members during rotation of the first and second tool members relative to the handle. In an example embodiment, the cam member of the first tool member is different than the cam member of the second tool members. As such, the cam follower engages the cam member of the first tool member during opening of the first tool member upon rotation of the first tool member through a first incidence angle relative to the first handle. In this regard, the cam follower engages the cam member of the second tool member during opening of the second tool member following rotation of the second tool member through a second incidence angle, different than the first incidence angle, relative to the first handle. In an example embodiment, the cam follower engages the cam member of the first tool member immediately upon opening of the first tool member. Conversely, the cam follower does not engage the cam follower of the second tool member immediately upon opening of the second tool member, but only engages the cam member of the second tool member during the opening of the second tool member after the second tool member has rotated through the second incidence angle, which is greater than zero.

The multipurpose tool of an example embodiment also includes first and second jaws rotatably connected to the first and second handles, respectively. Each jaw of this example embodiment includes a wall member. The multipurpose tool of this embodiment also includes first and second spring members configured to engage the wall members of the first and second jaws, respectively. The wall member of each jaw has a thickness that varies such that the first and second spring members engage thicker portions of the wall members of the first and second jaws, respectively, as the first and second handles are rotated from the closed position to the open position. The first and second handles each include opposed sidewalls. In an example embodiment, the first and second spring members are configured to provide a spring force to the wall members of the first and second jaws, respectively, that is directed through one of the sidewalls.

In a further example embodiment, a multipurpose tool is provided that includes first and second handles configured for relative movement between a closed position and an open position. The multipurpose tool also includes a plurality of tool members carried by and foldable into the first handle. In this regard, the first handle includes an axle upon which the plurality of tool members are rotatably mounted. The plurality of tool members include first and second tool members, each of which includes a cam member. The multipurpose tool further includes a cam follower configured to engage the cam member of each of the first and second tool members during rotation of the first and second tool members relative to the first handle. The cam member of the first tool member is different than the cam member of the second tool member. Thus, the cam follower engages the cam member of the first tool member during rotation of the first tool member upon rotation of the first tool member through a first incidence angle relative to the first handle. The cam follower engages the cam member of the second tool member during opening of the second tool member following rotation of the second tool member through a second incidence angle, different than the first incidence angle, relative to the first handle.

In an example embodiment, the cam follower engages the cam member of the first tool member immediately upon opening of the first tool member. Conversely, the cam follower does not engage the cam member of the second tool member immediately upon opening of the second tool member, but only engages the cam member of the second tool member during opening of the second tool member after the second tool member has rotated through the second incidence angle, which is greater than zero. A multipurpose tool of an example embodiment also includes first and second magnets carried by the first and second handles, respectively. The first and second magnets are aligned in an instance in which the first and second handles are in the closed position. The first and second magnets are configured to bias the first and second handles into the closed position.

The multipurpose tool of an example embodiment also includes first and second jaws rotatably connected to the first and second handles, respectively. Each jaw includes a wall member. The multipurpose tool of this example embodiment also includes first and second spring members configured to engage the wall members of the first and second jaws, respectively. The wall member of each jaw has a thickness that varies such that the first and second spring members engage thicker portions of the wall members of the first and second jaws, respectively, as the first and second handles are rotated from the closed position to the open position.

BRIEF DESCRIPTION OF THE DRAWINGS

Figure 1:
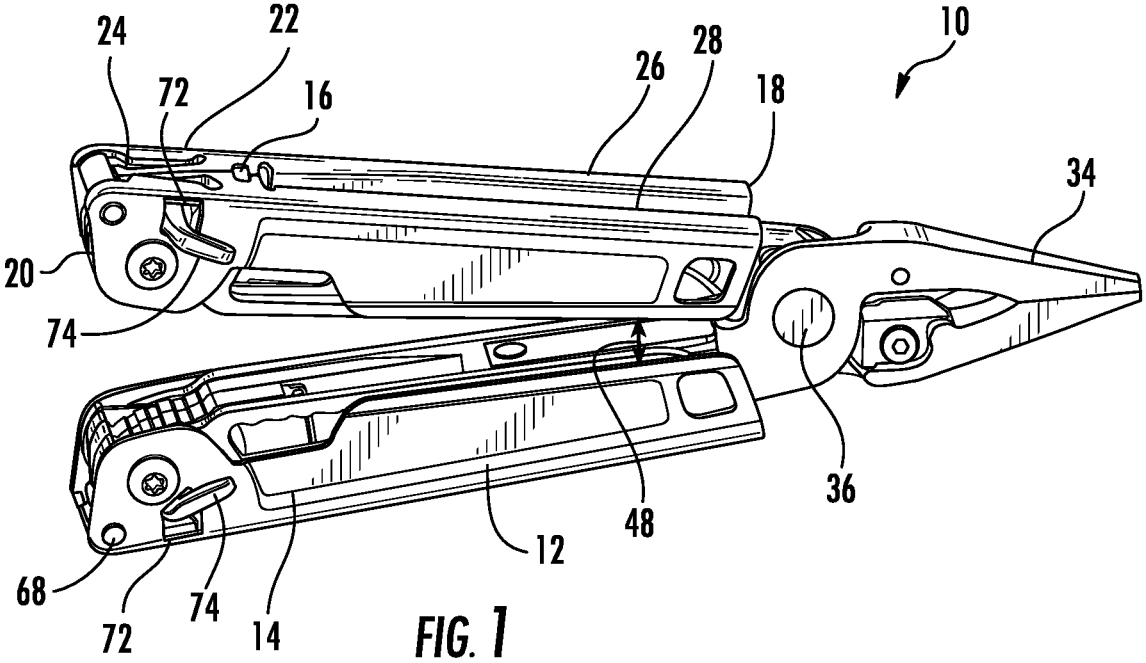
Figure 2:
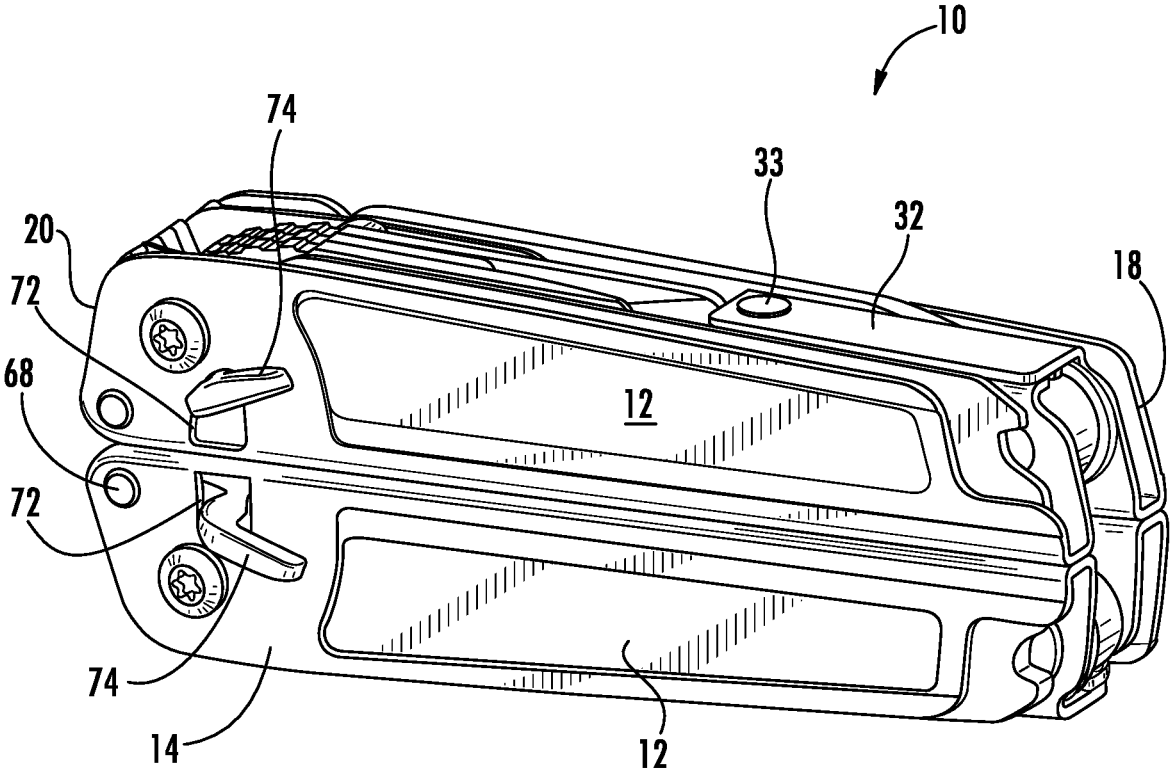
Figure 3A:
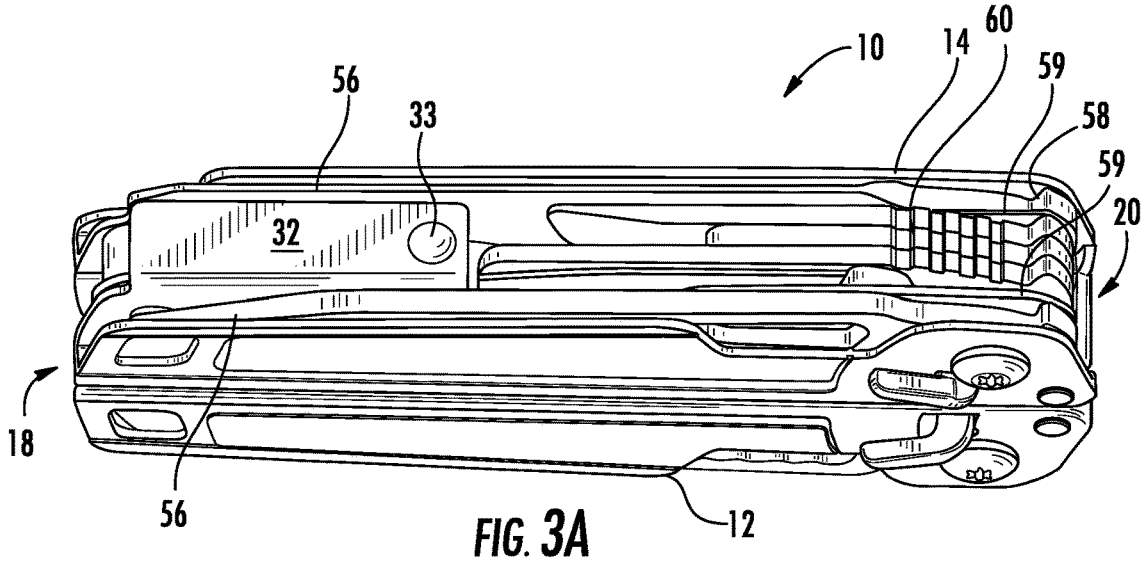
Figure 3B:
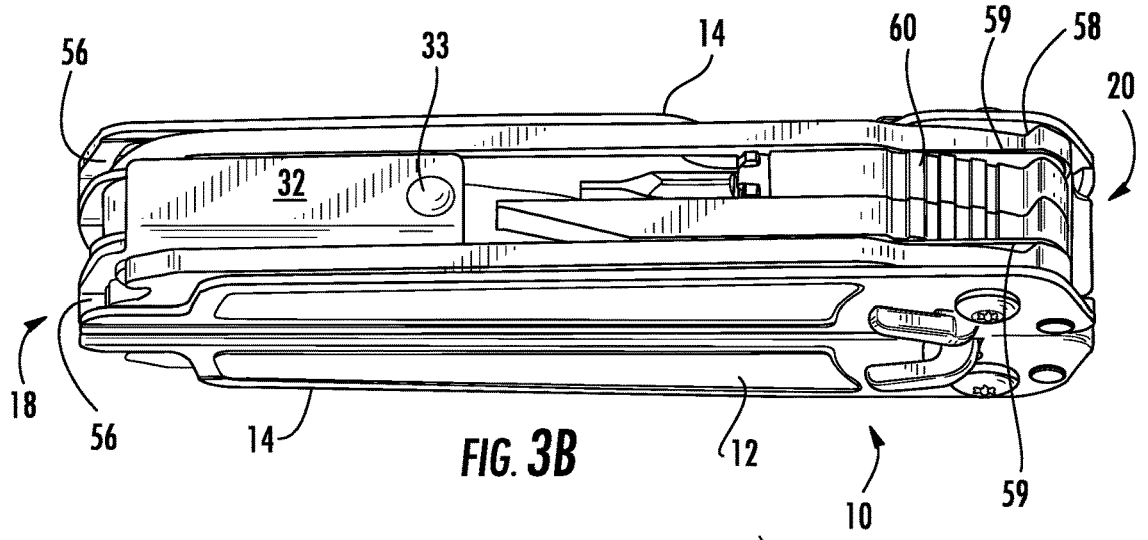
Figure 4:
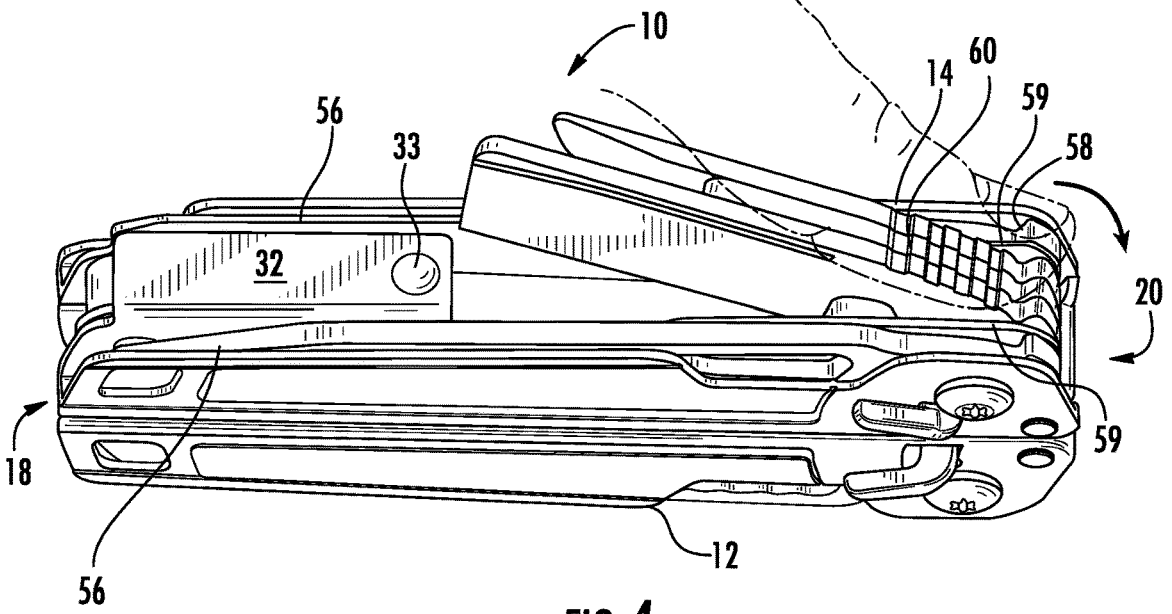
Figure 5:
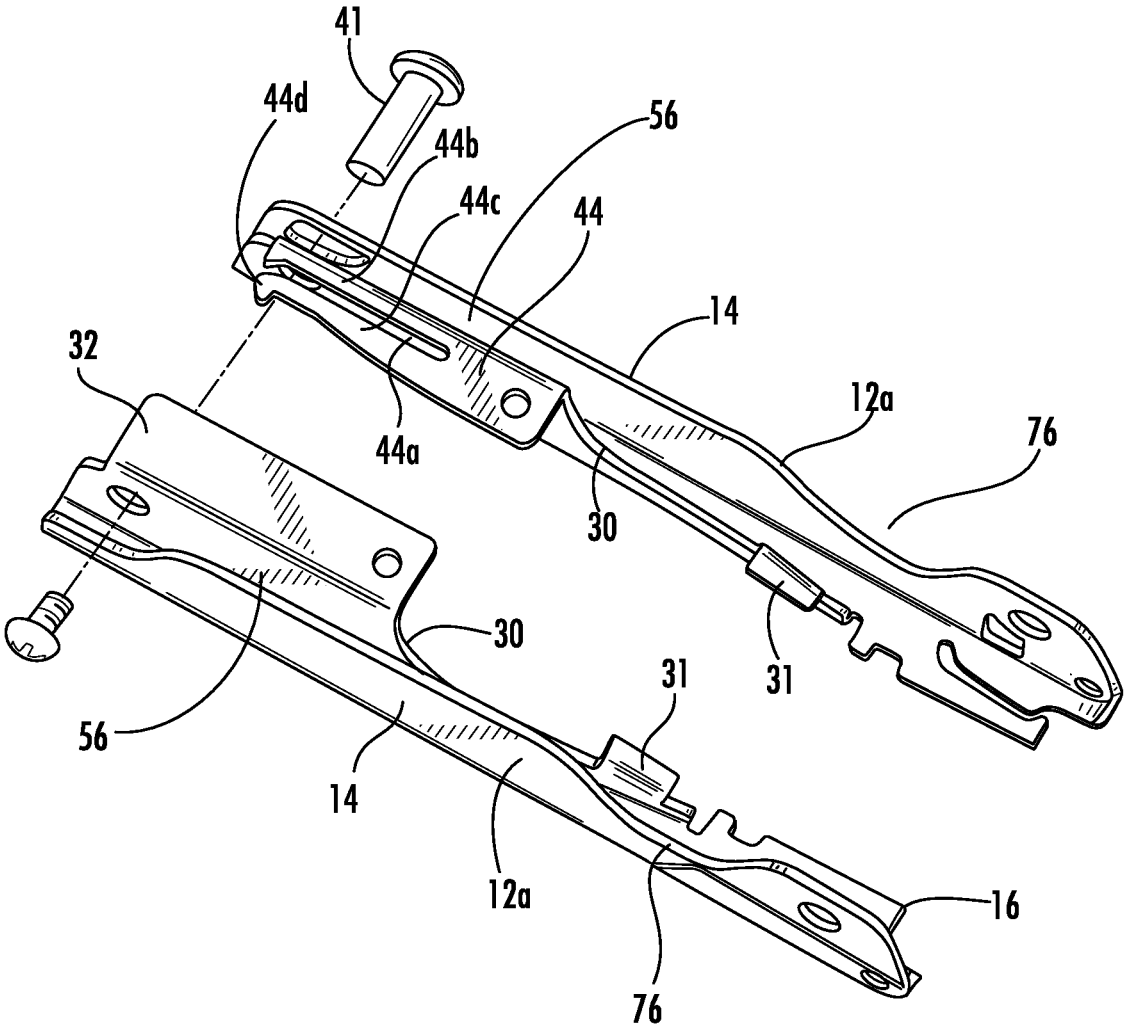
Figure 6A:
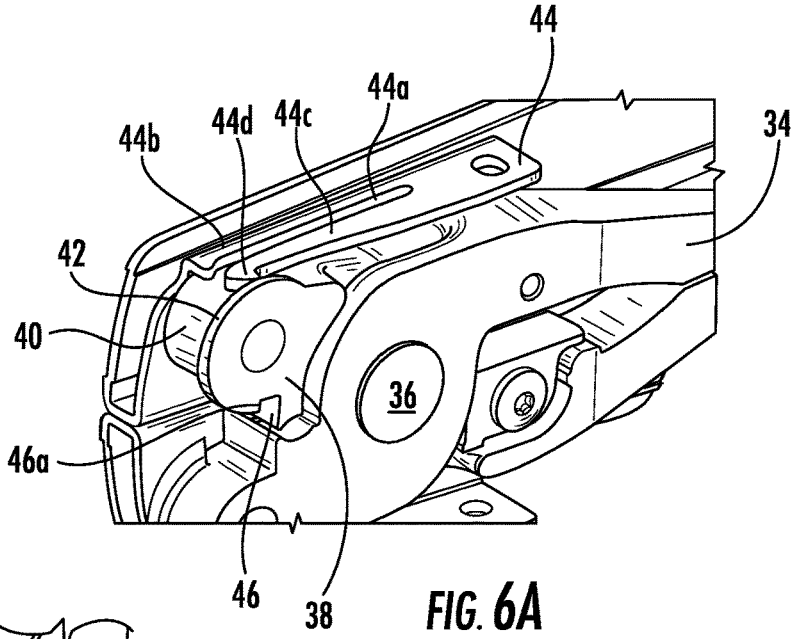
Figure 6B:
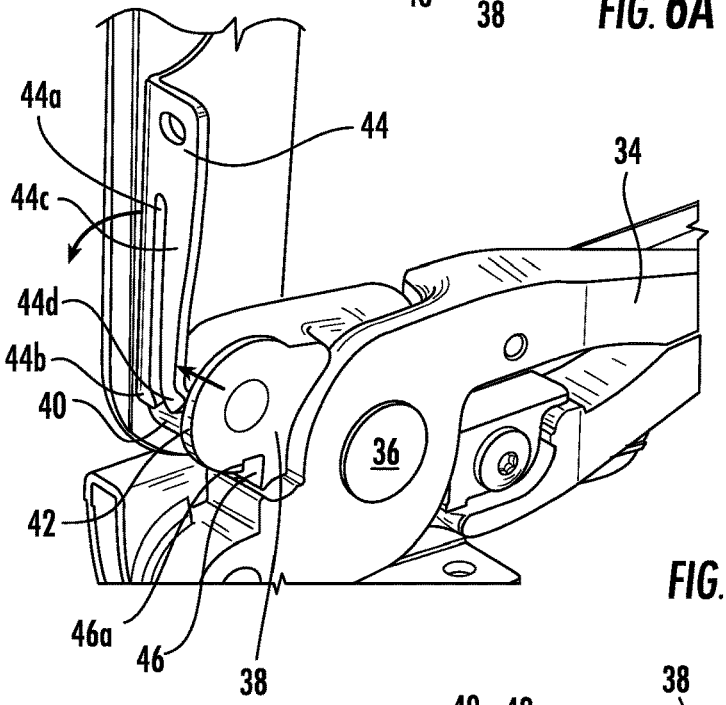
Figure 6C:
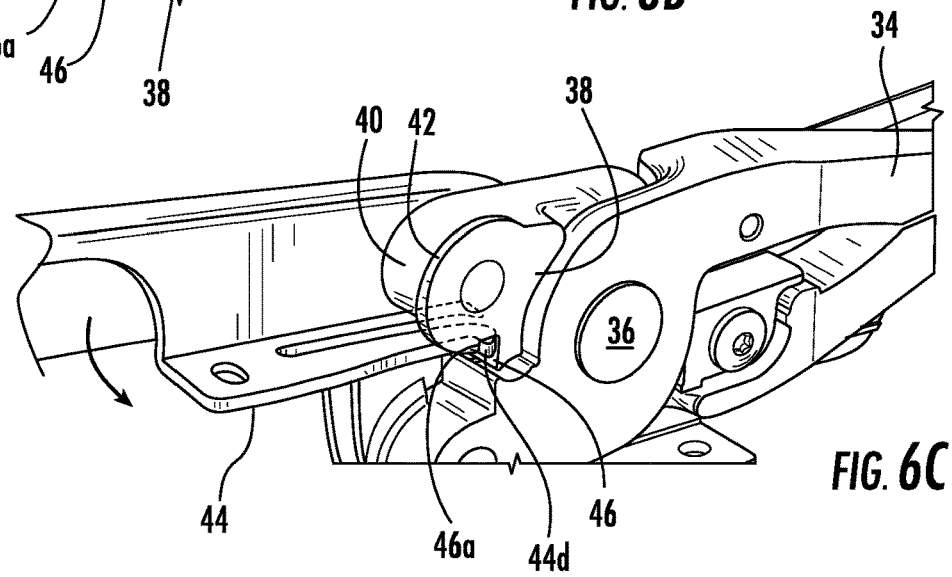
Figure 7:
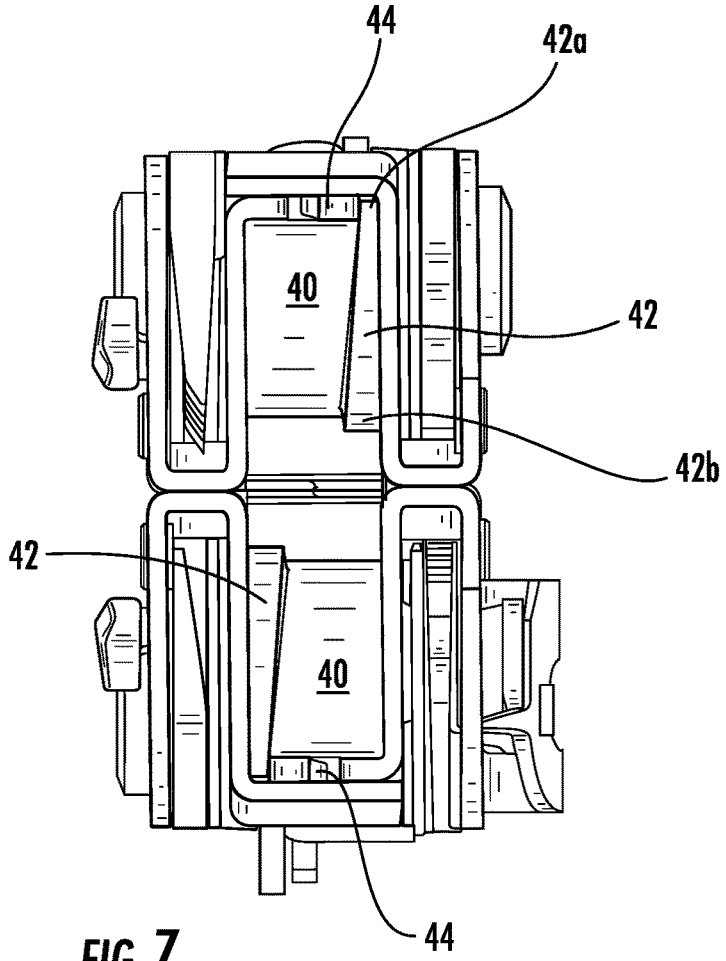
Figure 8:
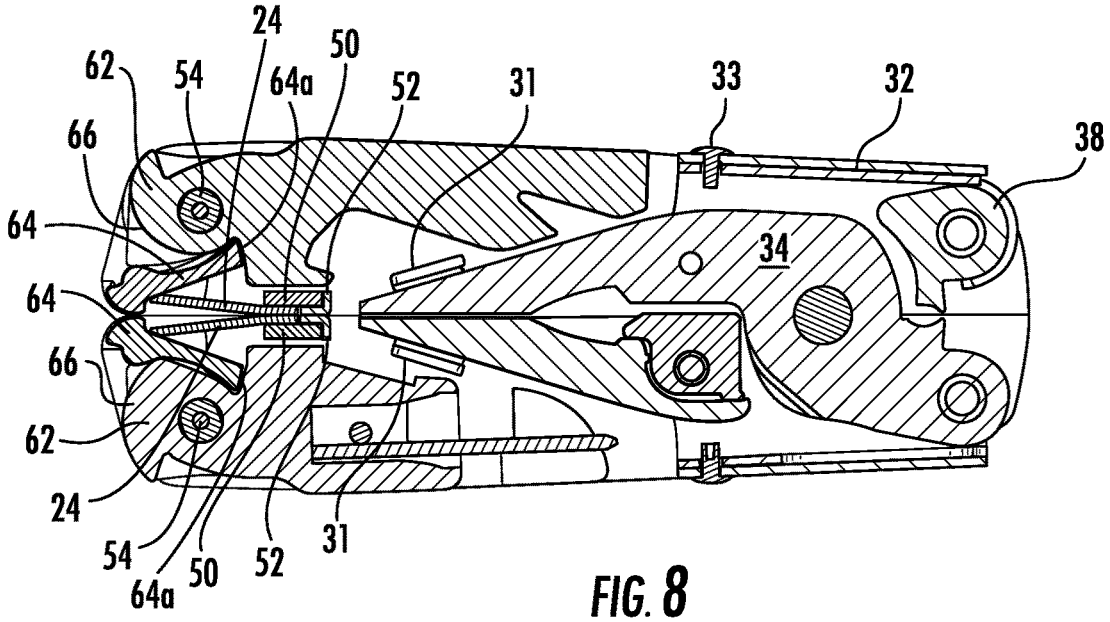
Figure 9:
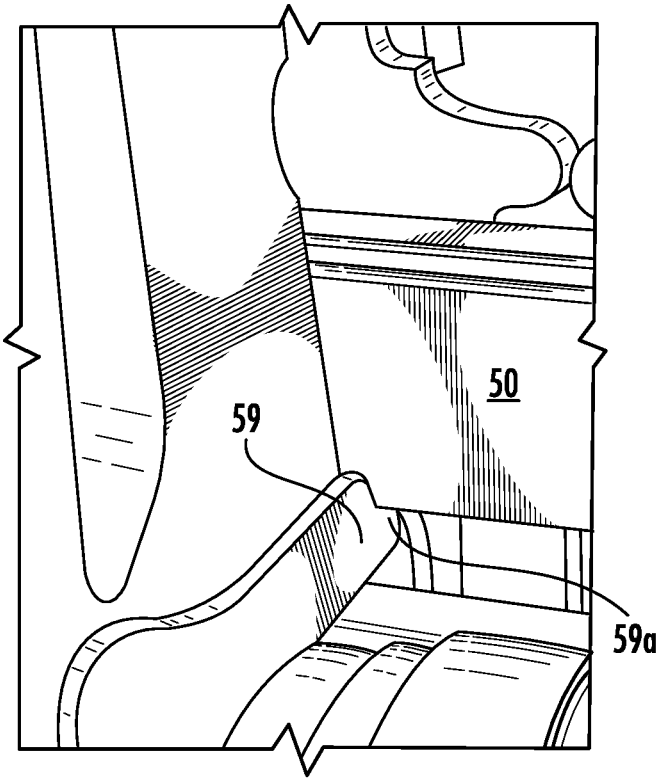
Figure 10A:
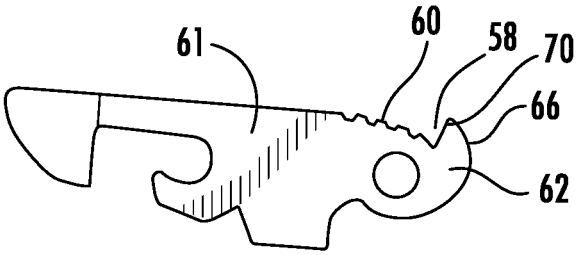
Figure 10B:
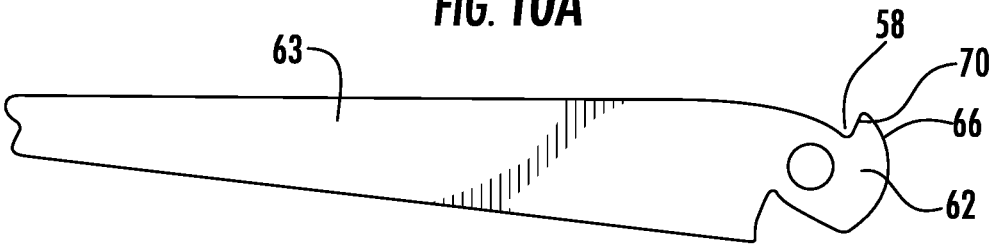
Figure 11A:
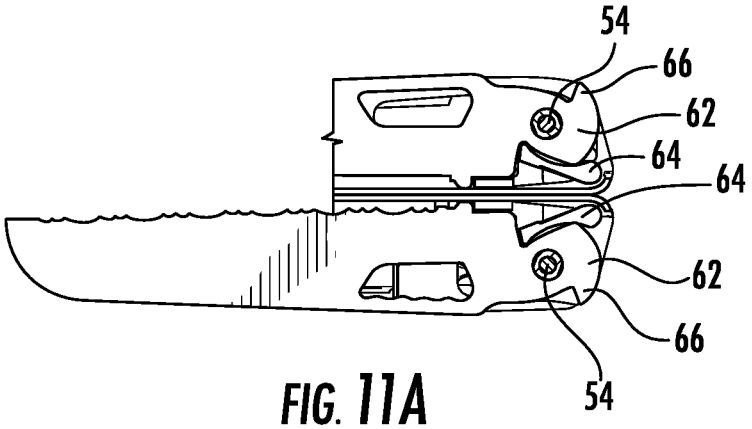
Figure 11B:
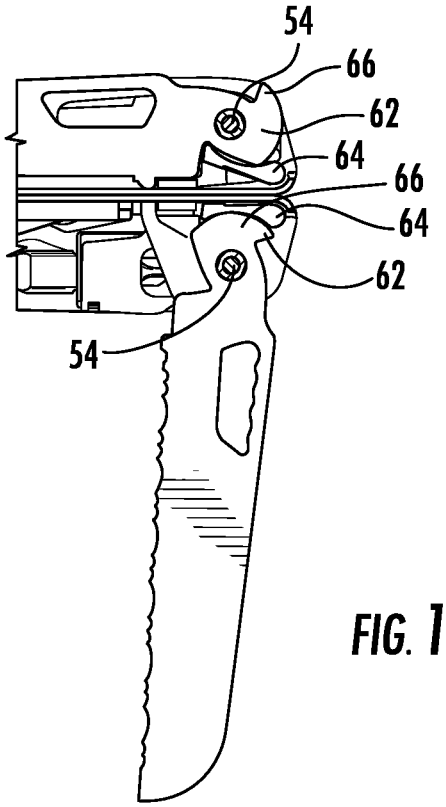
Figure 11C:
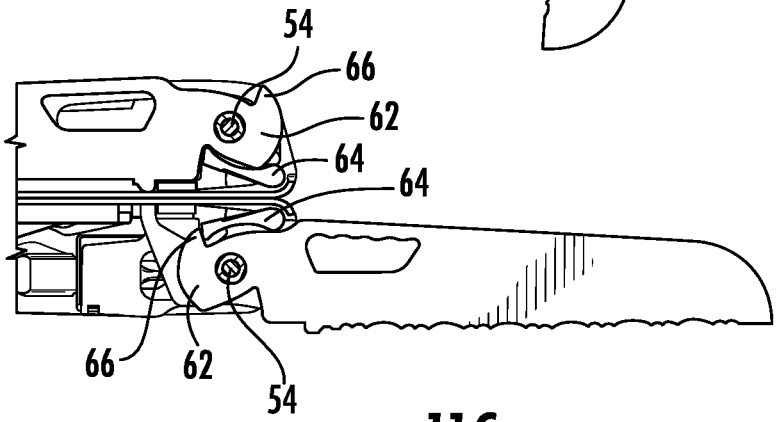
Figure 13:
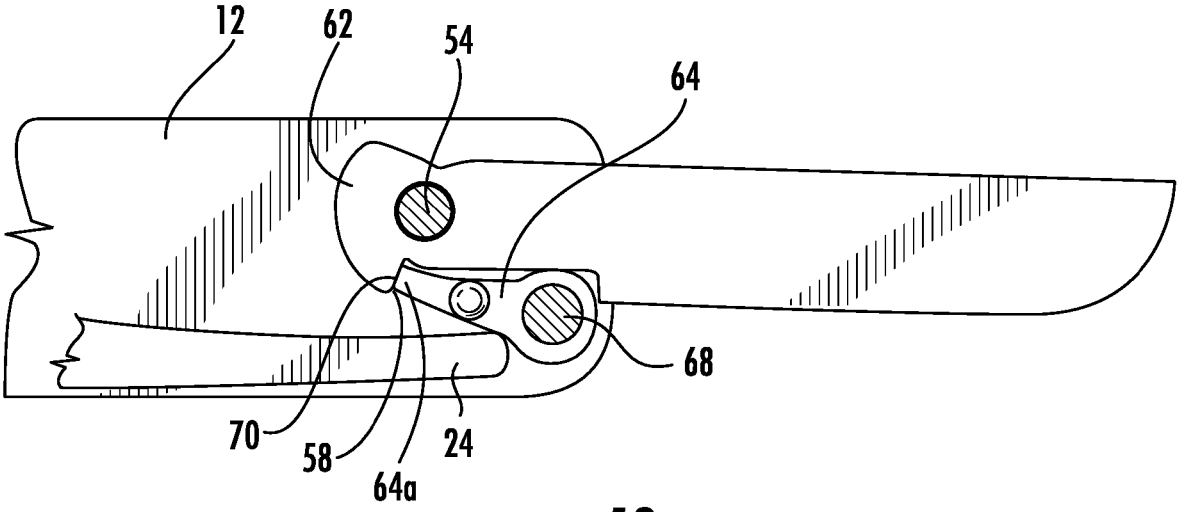
Figure 14:
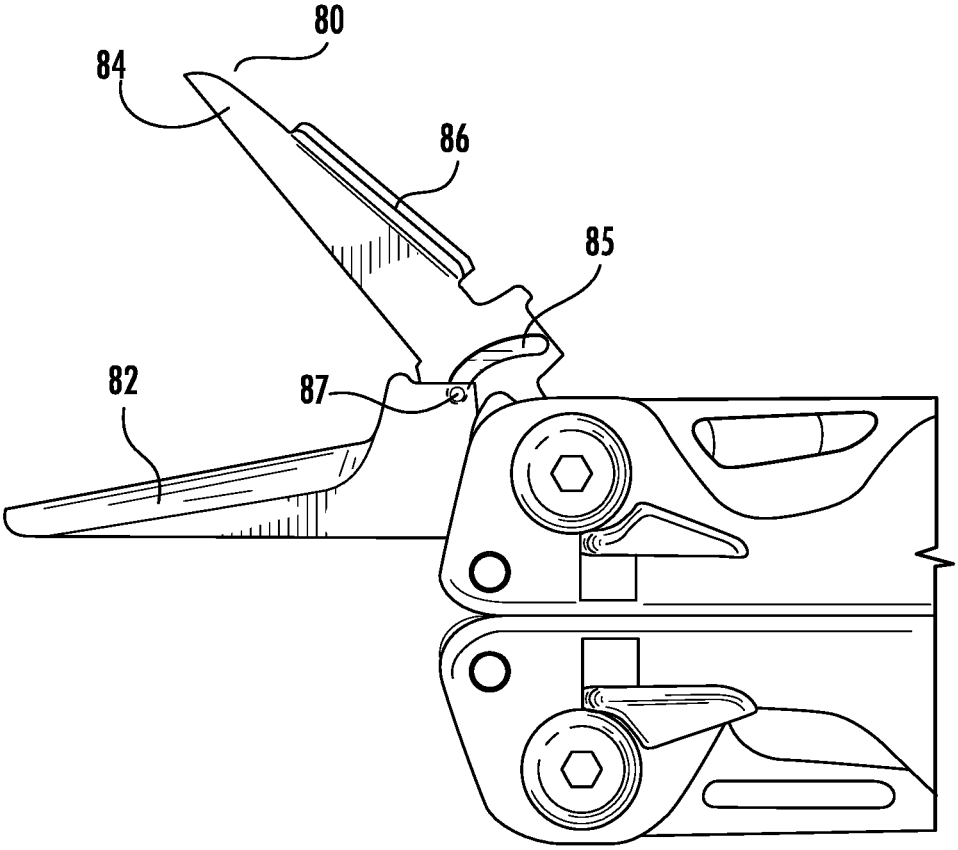
Figure 15:
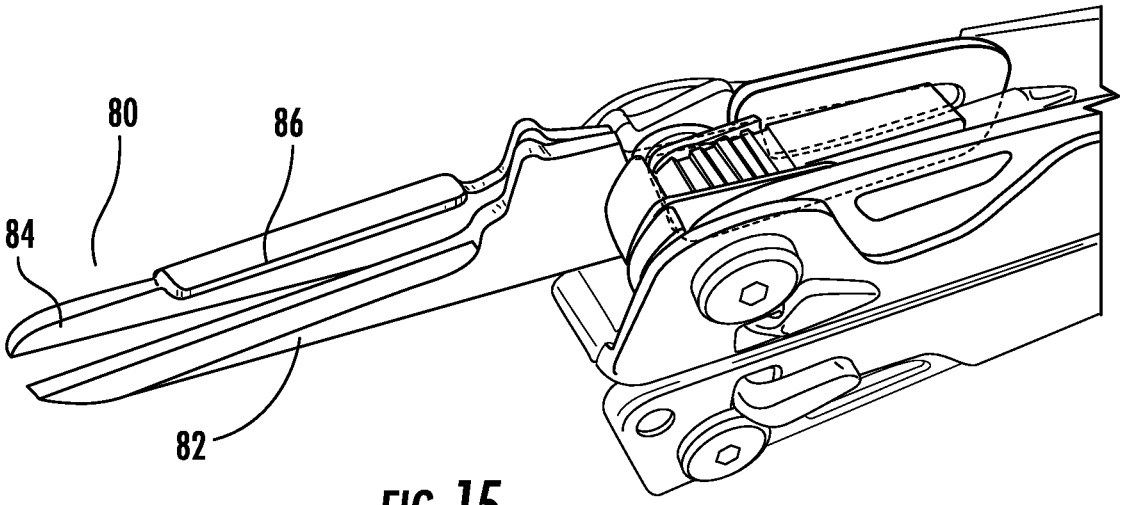
Figure 16:
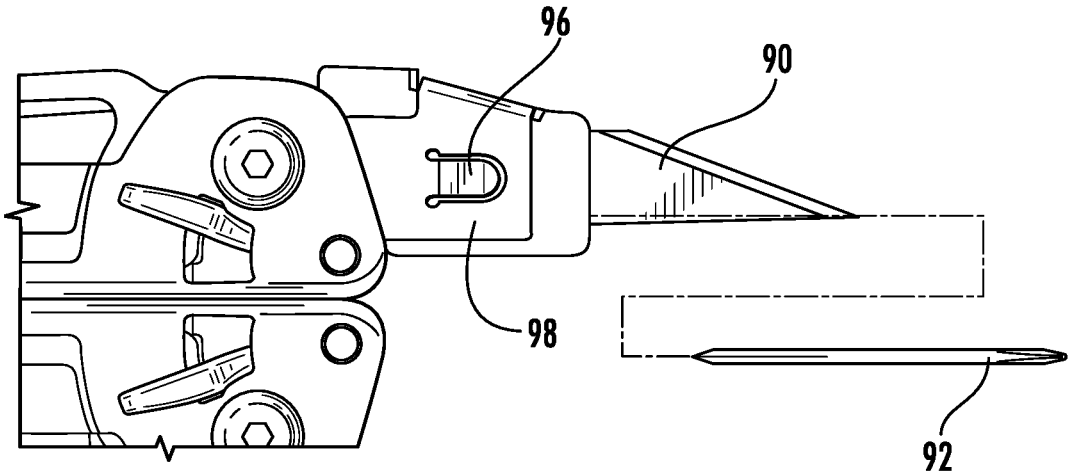
Figure 17:
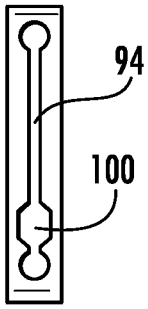
Figure 18:
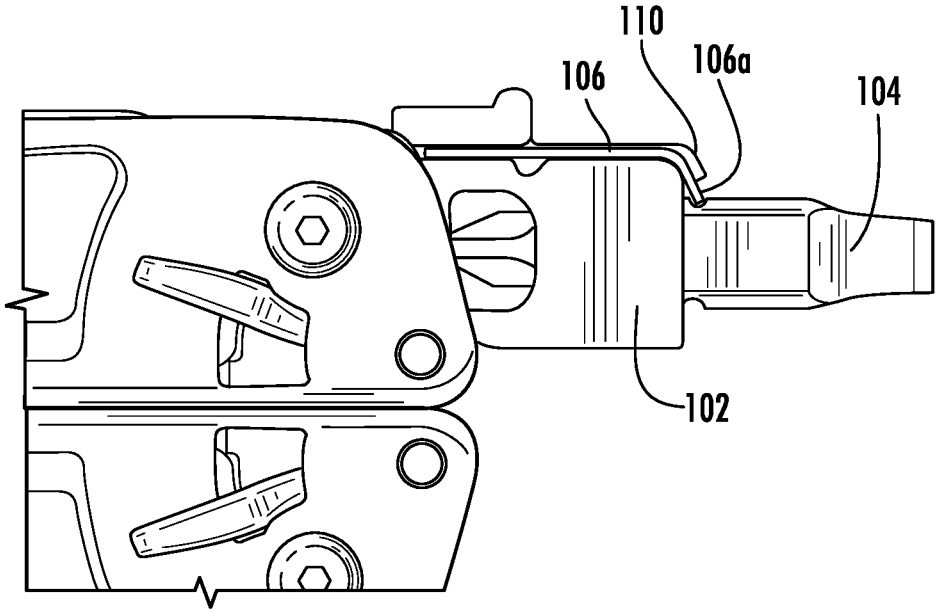
Figure 19:
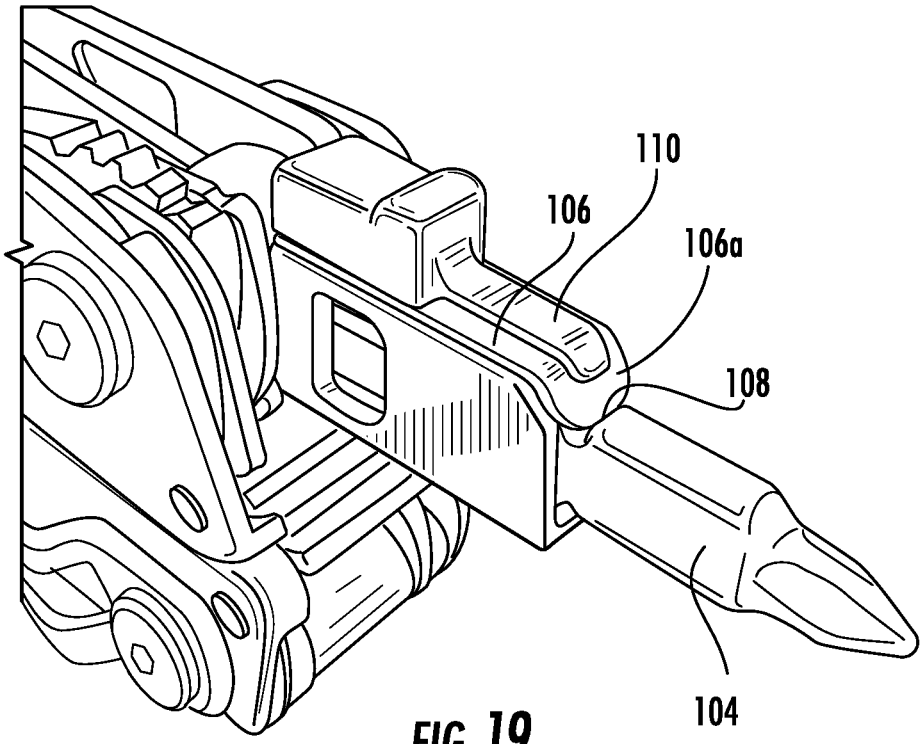

Having thus described embodiments of the invention in general terms, reference will now be made to the accompanying drawings, which are not necessarily drawn to scale, and wherein:

FIG. 1 is a perspective view of a multipurpose tool in accordance with an example embodiment of the present invention in which the multipurpose tool is in the open position;

FIG. 2 is a perspective view of a multipurpose tool in accordance with an example embodiment of the present invention in which the multipurpose tool is in the closed position;

FIGS. 3A and 3B are perspective views of two different sides of the multipurpose tool in accordance with an example embodiment of the present invention in which the multipurpose tool is in the closed position;

FIG. 4 is a perspective view illustrating engagement by a user of a notch defined by tool members of a multipurpose tool in order to rotatably open the tool members in accordance with an example embodiment of the present invention;

FIG. 5 is a perspective view of the handle portions of the multipurpose tool in accordance with an example embodiment of the present invention;

FIGS. 6A-6C are a sequential series of fragmentary perspective views of the jaws and a spring configured to interact with the cam member of a respective jaw as the handles are moved from a closed position to an open position in accordance with an example embodiment of the present invention;

FIG. 7 is an end view of a multipurpose tool of an example embodiment of the present invention which illustrates the cam members of the jaws;

FIG. 8 is a side view of the interior of a multipurpose tool in a closed position in accordance with an example embodiment of the present invention which illustrates the first and second magnets;

FIG. 9 is a fragmentary perspective view depicting the engagement of the magnet by the non-rotating spacer in accordance with an example embodiment of the present invention;

FIGS. 10A and 10B are perspective views to a shorter tool member and a longer tool member of a multipurpose tool in accordance with an example embodiment of the present invention which illustrates their different cam members;

FIGS. 11A-11C are a sequential series of fragmentary side views of the interior of a multipurpose tool as a longer tool member is moved from a closed position to an open position in accordance with an example embodiment of the present invention which illustrates the interaction of a cam follower with the cam member of a tool member;

FIGS. 12A-12D are a sequential series of fragmentary side view of the interior of a multipurpose tool as a shorter tool member is moved from a closed position to an open position in accordance with an example embodiment of the present invention which illustrates the interaction of a cam follower with the cam member of a tool member;

FIG. 13 is a schematic side view of the interior of a multipurpose tool in which a tool member is in the open position in accordance with an example embodiment of the present invention which illustrates the interaction of a spring member with a cam follower;

FIG. 14 is a side view illustrating a scissors tool member in accordance with an example embodiment of the present invention;

FIG. 15 is a perspective view of the scissors tool member of FIG. 14;

FIG. 16 is a side view of a tool member configured to alternately receive a knife blade and a screwdriver in accordance with an example embodiment of the present invention;

FIG. 17 is an end view of the tool member of FIG. 16 depicting the slot that, in turn, defines an enlarged portion;

FIG. 18 is a side view of a bit driver including a spring for engaging a bit member in accordance with an example embodiment of the present invention;

FIG. 19 is a perspective view of the bit driver of FIG. 18; and

FIGS. 20A-20D are a sequential series of perspective views illustrating a technique for assembling a multipurpose tool in accordance with an example embodiment of the present invention.

DETAILED DESCRIPTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Referring now to FIGS. 1-3, a tool, such as a multipurpose tool 10, according to an example embodiment to the present invention is depicted. While the tool will be described in the context of a multipurpose tool, other types of tools may readily employ components of embodiments of the present invention including the inclusion of those components by knives and other types of tools that are not considered multipurpose tools. For purposes of illustration, but not of limitation, however, a multipurpose tool employing embodiments of the present invention will now be described.

The multipurpose tool 10 includes a plurality of handles 12 configured for movement relative to one another, as well as a plurality of tool members carried by at least one of the handles. Typically the multipurpose tool includes a pair of generally elongate handles that extend in a lengthwise or longitudinal direction between opposed ends. As a result of their connection, such as a pivotal connection, to one another and/or to one or more of the tool members, the handles can be moved toward and away from one another, such as to actuate a tool member as described below.

In this regard, the multipurpose tool 10 may be configured such that the handles 12 are adapted for relative movement between an open position as shown in FIG. 1 and a closed position as shown in FIGS. 2-3. As will be apparent, the multipurpose tool has a compact form factor in the closed position to facilitate transport and storage of the multipurpose tool. One or more tool members carried by the multipurpose tool are generally accessible while in the multipurpose tool is in the closed position. While the multipurpose tool is more expansive in the open position, one or more different tool members of the multipurpose tool are accessible and capable of being utilized in the open position, even though those same tool members(s) are stowed and generally inaccessible in the closed position.

Each handle 12 includes a pair of opposed sidewalls 14 and, in some embodiments, a floor 16 having a web extending between the opposed sidewalls, thereby defining a channel within the handle to receive and store a plurality of tool members. The handle of an example embodiment has a cross-sectional shape, taken in a lateral direction perpendicular to a longitudinal axis defined by the elongate handle, that varies along the length of the handle. In this regard, each handle may include a proximal end 18 about which the handle pivots in order to transition between the closed and opened positions. Each handle of this example embodiment also includes a distal end 20, longitudinally opposed to the proximal end. In this example embodiment, the portion of the handle closest to, such as adjacent to, the proximal end of the handle, has a generally U-shaped channel defined by the opposed sidewalls and the floor that extends therebetween. Even within the portion of the handle that defines a U-shaped channel, the floor need not extend continuously between the opposed sidewalls. Instead, the floor of the illustrated embodiment includes a first floor portion 22 proximate the distal end of the handle that generally extends between the opposed sidewalls and that defines a spring member 24 as described below. In addition, the floor of the illustrated embodiment includes a second floor portion that extends from the first floor portion to the proximal end of the handle. The second floor portion includes edge members 26 that extend laterally inward from the opposed sidewalls. The edge members do not extend across the channel between the opposed sidewalls, but, instead, extend only part way across the channel so as to define an opening into the channel between the edge members. In an example embodiment, the interior edge of the edge members includes an upwardly turned portion 28.

In contrast to the U-shaped channel defined by the portion of the handle 12 closest to the proximal end 18, the portion of the handle closest to, such as adjacent to, the distal end 20 of the handle has a different shape, such as a W-shape. In this regard, the channel defined by the pair of opposed sidewalls 14 and the floor 16 is not open between the opposed sidewalls. Instead, within the channel defined by the opposed sidewalls, such as in a medial portion of the channel between the pair of opposed sidewalls, a pair of intermediate sidewalls 30 extend into the channel. The intermediate sidewalls may extend upwardly into the channel from the interior edge of the edge members 26 and may be interconnected at their upper edges by an interconnecting web 32. The intermediate sidewalls may be the same height as the opposed sidewalls or may have a different height, such as by being shorter than the opposed sidewalls. Thus, the portion of the handle proximate the distal end includes the pair of opposed sidewalls and the edge members of the floor that extend inward into the channel from each of the pair of opposed sidewalls. The intermediate sidewalls then extend upwardly from the interior edge of the edge members and are interconnected to one another with the interconnecting web so as to define the W-shaped channel.

Each of the two handles 12 of the multipurpose tool 10 may have the same configuration, such as by having a hybrid U-W configuration as a result of the handle having one portion with a U-shaped channel and another portion with a W-shaped channel. Alternatively, the first and second handles may be differently shaped, such as with one of the handles having a U-shaped channel and the other handle having the hybrid U-W configuration as described above.

Although each handle 12 may be a single unitary structure, each handle may, instead, be formed of a plurality of discrete handle portions 12*a* that are joined to one another to form the resulting handle. In the embodiment illustrated in FIG. 5, each handle is formed of two handle portions that are attached to one another to form the handle. Each handle portion of this example embodiment includes a sidewall 14, e.g., an outer sidewall, a portion of the floor 16 including the edge member 26 that extends inwardly from the respective sidewall, an intermediate sidewall 30 and an interconnecting web 32. The interconnecting webs of the handle portions of this embodiment may be disposed so as to overlay one another and may then be joined, such as with a rivet 33, in order to form the handle.

The multipurpose tool 10 of an example embodiment depicted in FIGS. 1 and 6 includes a tool member in the form of jaws 34 that are pivotally connected to one another, such as at a pivot point 36. Each jaw includes a cam member 38 disposed, typically entirely or substantially, within the proximal end 18 of a respective handle 12. In this regard, the first and second handles may include a hub 41 that extends between the intermediate sidewalls 30 of the W-shaped portion of the handle, as shown in FIG. 5. The hub of an example embodiment may be formed by a pin and screw that engage one another. The hub of this example embodiment does not extend between the opposed sidewalls 14 (hereinafter also referenced as the outer sidewalls as a result of their positional relationship to the intermediate sidewalls), but may be limited to extension between the intermediate sidewalls. The cam member of each jaw defines an opening through which the hub of the respective handle extends such that each jaw is both rotatably connected to a respective handle and pivotally connected to the other jaw member. Thus, the handles may be rotated from a closed position in which the jaws are folded through the opening into the channel between the edge members 26 so as to be stowed within the channel defined by the handle to an open position in which the jaws extend beyond the handles. In the closed position and as shown in FIGS. 5 and 8, the handles may also include internal jaw stop members 31 that the jaws may contact as the handles are folded from the open position to the closed position so as to maintain the jaws in the desired position within the respective handles. However, in the open position, the handles may be alternately moved toward and away from one another so as to open and close the jaw members. The multipurpose tool may include a variety of different types of jaws including pliers, scissors or the like. In an example embodiment in which the jaws include a pair of pliers, the pair of pliers may also include a pair of wire cutters carried by the respective jaws to further increase the functionality of the multipurpose tool.

As shown in FIGS. 6A-6C, the cam member 38 of each jaw 34 defines a curved exterior surface 40 and a wall member 42 extending from the curved exterior surface, such as by extending outwardly from the curved exterior surface. In an example embodiment, the wall member extends at least partially circumferentially about the curved surface along one edge of the curved surface. The wall member has a thickness that gradually increases in a circumferential direction about the curved surface of the cam member from a thinner end 42*a* to a thicker end 42*b*, as shown in FIG. 7. In an example embodiment, the thickness of the wall member increases linearly, although the thickness of the wall member may increase in other manners. The wall member may increase in thickness by various amounts. In an example embodiment, however, the wall member may double in thickness from the thinner end that the respective spring engages while the handles 12 are in the closed position to the thicker end that the respective spring member engages as the handles approach the open position.

In this example embodiment, the multipurpose tool 10 also includes a pair of springs 44, one of which is configured to engage the wall member 42 of the cam member 38 of each jaw 34. In an example embodiment depicted in FIGS. 5 and 6, each spring is a cantilevered spring that defines a slot 44*a* to form the spring. Although the spring may be a discrete component that are attached to the respective handle 12, the spring of an example embodiment is integral with and defined by the interconnecting web 32 of one of the handle portions 12*a*, such as the innermost one of the interconnecting webs. In this example embodiment, the spring may be attached to the other handle portion, such as by the rivet 33, in order to positionally affix the spring relative to the respective handle. In this example embodiment, the spring generally extends in a planer manner alongside the outermost one of the interconnecting webs.

Each spring 44 may include a web 44*b* that operably contacts an intermediate sidewall 30 of the W-shaped portion of the handle 12, while an arm 44*c* of the spring is biased against the wall member 42 of the cam member 38 of the respective jaw 34. In the embodiment in which the spring is formed by and integral with one of the handle portions 12*a* as shown in FIG. 5, the web of the spring is in operable contact with the intermediate sidewall as a result of the spring being integral with the handle portion including the intermediate sidewall. Regardless, each spring is generally formed relative to the handle and to the cam member such that the spring is compressed between the intermediate sidewall of the W-shaped portion of the handle and the wall member of the cam member. As a result, each spring is configured to apply forces that extend laterally across the respective handle, such as in a direction extending through the outer sidewalls 14 and the intermediate sidewalls 30 of the handle. Thus, the spring does not apply appreciable, if any, force to the floor 16 of the handle and, instead, relies upon the generally greater strength and rigidity afforded by the sidewalls of the handle for support.

As shown in FIG. 6A, when a handle 12 is in the closed position, the arm 44*c* of the spring 44 operably contacts a thinner portion of the wall member 42 of the cam member 38 of the respective jaw 34, such as by operably contacting the thinner end 42*a*. However, as the handle is moved from the closed position to an open position and the cam members of the handles rotate about the hub 41 relative to the respective spring, the arm of each spring member generally rides against and contacts a progressively thicker portion of the wall member of the cam member of the jaw, as shown in FIG. 6B. As a result of the reduction in the width between the intermediate wall 30 of the W-shaped portion of the handle and the wall member, the bias force exerted by the spring upon the wall member gradually increases as the handle is rotated from the closed position to the open position. As such, a user must correspondingly provide a larger opening force to the handles to complete the transition of the handles from the closed position to the open position.

In an example embodiment, the portion of the arm 44*c* of the spring 44 that contacts the wall member 42 of a respective jaw 34 rotates beyond the wall member as the handles 12 reach the fully open position, as shown in FIG. 6C. In this regard, the cam member 38 of the jaw may define a notch 46 circumferentially adjacent the thicker end 42*b* of the wall member, as shown in FIG. 6C. In this example embodiment depicted in FIGS. 5 and 6, the arm of the spring may include a positive cam follower in the form of a protruding contact portion 44*d* extending outwardly from the remainder of the arm toward the wall member so as to operably engage the wall member during rotation of the handles from the closed position to the open position. As the handles reach the fully open position, the contact portion of the arm of the spring may rotate beyond the thicker end of the wall member and engage the notch defined by the cam member of the respective jaw, thereby providing haptic feedback, such as one or both of tactile an auditory feedback, informing the user that the jaw is fully deployed. In addition, the handle, such as the interconnecting web 32 of the W-shaped portion of the handle, may also engage a stop 31 defined by the jaw so as to provide a physical stop to further rotation of the handles relative to the jaws and to also provide haptic feedback informing the user that the jaw is fully closed.

The jaws 34 may be configured and the handles 12 may be rotatably connected to the cam members 38 of their respective jaws in such a manner such that a gap 48 is defined between the handles along the entire length of the handles once the handles are in the fully open position. By requiring a gap between the handles along the entire length of the handles, the multipurpose tool 10 may avoid pinching the user as the handles are fully opened.

The engagement of the contact portion 44*d* of the arm 44*c* of the spring 44 with the notch 46 defined by the cam member 38 of a respective jaw may prevent, or at least reduce the likelihood of, inadvertent closure of the handles 12 as the user must apply sufficient closure force to the handles to cause the spring to deflect such that the contact portion is disengaged from the notch and is transitioned so as to again ride along the wall member 42. To facilitate this transition, the notch defined by the cam member and the contact portion of the arm of the spring may have an at least partially rounded or angled profile. For example the thicker end 42*b* of the wall member may include an angled edge 46*a* that at least partially defines the notch so as to ramp the contact portion from the notch onto the wall member upon the application of sufficient closure force.

Thus, the multipurpose tool 10 provides for smooth opening and closing of the handles 12 in order to alternately deploy and stow the jaws 34. However, the multipurpose tool prevents inadvertent opening of the handles by requiring the user to apply increased force to fully open the handles as a result of the interaction of the springs 44 and the wall members 42 of the cam members 38 of the respective jaws. Similarly, the multipurpose tool prevents inadvertent closure of the handles as a result of the engagement of the contact portion 44*d* of the springs within the corresponding notch 46 defined by the cam member and the requirement for the user to apply additional force to commence the folding of the handles.

In order to bias the handles 12 into a closed position and to avoid inadvertent opening of the handles from the closed position, the multipurpose tool 10 may include a first magnet carried by one of the handles and, more typically, first and second magnets 50 carried by the first and second handles, respectively, as shown in FIG. 8. In this regard, the first and second magnets may be spatially aligned with one another when the handles are in the closed position. The magnets generate a magnetic force. The magnetic force is directed in a flux path that extends through the handles and/or components, such as the tool members, carried by the handles. The magnetic force is an attractive magnetic force such that the magnetic force biases the handles toward one another in the closed position. The magnets are configured, however, such that the magnetic force may be overcome by an opening force applied by a user in order to intentionally open the handles from the closed position to the open position. Thus, the magnetic force prevents the inadvertent opening of the handles from the closed position to the open position, but allows the opening of the handles once the user has supplied a sufficient force.

Additionally, the attractive magnetic force provided by the magnets 50 carried by the handles 12 is primarily applicable when the handles are relatively close to one another, such as in an instance in which the handles have been opened so as to define an internal angle therebetween of no more than about 20°. Thereafter, as the handles are more fully opened, the magnetic force has much more limited or even negligible impact upon the force required to open the handles. Thus, the combination of the magnetic attractive forces provided by the magnets while the handles are in a closed or nearly closed position and the interaction of the springs 44 with the wall members 42 of the cam members 38 of the jaws 34 provide for a smooth opening of the handles from the closed position to the open position. Indeed, the multipurpose tool of an example embodiment may be opened by a user holding the multipurpose tool 10 with one hand, such as by holding one of the handles of the multipurpose tool, and then applying a rotating force to the multipurpose tool, such as by flipping the handle that is not being held by the user away from the handle that the user is holding, thereby causing the magnetic force to be overcome and the distal ends 20 of the handles to separate with the handles thereafter rotating from the closed position to the open position. Conversely, when the handles are closed from the open position to the closed position, the magnetic forces provided by the magnets may assist with fully closing the handles as the distal ends of the handles are brought relatively close to one another.

The magnets 50 may be carried by the handles 12 in various manners. In an example embodiment, however, the magnets are disposed within a carrier 52, such as a holder formed from a plastic or metal material. The carrier, in turn, may be mounted within the channel defined by a respective handle, such as by either being mechanically attached to the handle or being positioned relative to the other components within the handle such that the carrier is secured via an interference fit within the channel defined by the respective handle. The magnets are generally carried by the handles so as to be closer to the distal ends 20 of the handles that separate from one another as the handles are moved from the closed position to the open position than the proximal ends 18 of the handles. In one example embodiment, the magnets are positioned by a distance of about 5% to about 25% of the length of the handles from the distal end of the handles.

In addition to the jaws 34, the multipurpose tool 10 generally includes a number of other tool members. In the illustrated embodiment, the distal end 20 of each handle 12 also includes an axle 54 that extends between the opposed sidewalls 14 of the handles. Thus, the axle at the distal end of the handles is longer than the hub 41 at the proximal end 18 of the handles. A plurality of the tool members of the multipurpose tool may be rotatably mounted upon the axle proximate the distal end and, in an example embodiment, a plurality of tool members are mounted upon the axles at the distal ends of both the first and second handles. Unlike the jaws 34 that are disposed within the handles and are inaccessible when the handles are in the closed position, the tool members are configured to be opened while the handles are in the closed position and, as such, open through the surface of the handles (opposite the floor 16) that is exposed when the handles are in the closed position.

As a result of the hybrid U-shaped and W-shaped handle 12, the tool members may include a combination of shorter tool members and longer tool members, as shown in FIGS.

3A and 3B. In this regard, the tool members are rotatably mounted upon the axle 54 in the U-shaped portion of the handle. Thus, the shorter tool members are generally those tool members disposed within the more central portion of the channel whose length is limited by the intermediate sidewalls 30 and interconnecting web 32 of the W-shaped portion of the handle. Thus, these shorter tool members have a length such that each shorter tool member extends only through the U-shaped portion of the handle and does not extend into the W-shaped portion of the handle. Conversely, while also being rotatably mounted upon the same axle, the longer tool members extend through not only the U-shaped portion of the handle, but through at least a portion of the W-shaped portion of the handle. In this regard, the W-shaped portion of the handle defines a pair of side channels 56 on opposite sides of the intermediate sidewalls, as shown in FIGS. 3 and 5. In this regard, each side channel is defined between a pair of intermediate and outer sidewalls and generally includes a floor formed by the edge member 26 extending inwardly from the respective outer sidewall. Since the side channels are generally positioned proximate the outer sidewalls of the handle, the longer tool members are also generally mounted upon the axle so as to be proximate the outer sidewalls. Thus, the shorter tool members are generally disposed on the axle between the longer tool members. As shown in FIGS. 3A and 3B, the handles may also include non-rotating spacers 59 positioned between the shorter tool members and the longer tool members.

While the multipurpose tool 10 may include a variety of different tools and different combinations of tools depending upon the type of multipurpose tool, the user preferences or the like, examples of some of the shorter tool members include a bit driver, a file, a pair of scissors, a bottle opener, a screwdriver, an a small knife, while the longer tool members may include one or more knife blades, a saw blade and/or a file. By including both longer tool members and shorter tool members, the utility of the resulting multipurpose tool may be enhanced, particularly with the inclusion of longer tool members that are selected such that the functions performed by the longer tool members, such as the knife blades and saw blades, can be performed more efficiently as a result of the increased length relative to the shorter tool members. Additionally, the handles 12 may be formed, such as with rounded corners, and the tool members may be disposed within the handles while in the closed position in order to provide a relatively smooth surface for the user to grasp and press against while utilizing the tool members, particularly the longer tool members.

Although the tool members may be opened in various manners, the tool members of an example embodiment include a notch 58 proximate the axle 54 upon which the tool members are mounted and, in an example embodiment, positioned closer to the distal end 20 of the handles 12 than the axle. As shown in FIGS. 3A and 3B, the notch extends laterally across the tool members mounted upon the axle in a direction extending between the opposed sidewalls 14 of the handle. The notch is defined by the edge of the tool members that is exposed in an instance in which the tool members are folded into the channel defined by the handle. In other words, the notch opens outwardly from the multipurpose tool 10 in an instance in which the tool members are folded into the channel defined by the handle so as to serve as a finger ledge or hook to be engaged by the user in order to at least partially rotatably open the tool members relative to the handle. Upon application of a force by the user to the notch as shown in FIG. 4, such as by positioning the thumb of the user upon the rear surface of the tool members that are exposed within the channel of the handle and applying a force, such as a sliding force directed toward the distal end of the handles, with the thumb of the user engaging the notch, one or more of the shorter tool members may be rotatably opened, at least partially, from the respective handle. In this regard, a notch may be defined in a uniform and aligned manner by each of the shorter tool members mounted upon the axle such that the notch defined by each of the shorter tool members carried by a respective handle may be engaged at one time by the user, such as by the thumb of the user applying the sliding motion toward the distal end of the handle. As a result the tool members may be readily accessed by a user using one hand, such as the thumb of the user, even while the user wearing gloves without requiring the user to use their fingernails in order to pry the tool members out of the handle. Although the longer tool members may also define a notch, the longer tool members of some embodiments do not include a notch and are, instead, accessed via a cutout 76 as described below. In this example embodiment, the shorter tool members may exhibit clumping in which all or at least a plurality of the shorter tool members are at least partially opened at the same time by the application of the distally directed sliding force by the user. Once the plurality of shorter tool members have been at least partially opened, such as in a clumped fashion, the user may more readily identify the tool member that the user desires to utilize and may then close the other tool members and fully open the tool member that is desired to be utilized. Thus, the user is largely spared from having to identify the particular tool member that is desired to be utilized while the tool members are fully folded into the handle and similarly is spared from simply having to guess and repeatedly open different ones of the tool members, one at a time, in an effort to locate the desired tool member. Instead, the opening of a plurality of tool members in a clumped fashion with the single application of an opening force by the user allows the user to more readily identify and select the tool to be utilized while simply folding the other tools back into the handle.

The non-rotating spacers 59 that separate the shorter tool members from the longer tool members effectively prevent the longer tool members from being opened when the user engages the notches defined by the shorter tool members and rotatably opens the shorter tool members, thereby avoiding inadvertent deployment of the longer tool members. The spacers may be configured not to rotate in various manners. In one embodiment, the spacers are mounted on the axle 54 and include a finger 59*a* that extends into the channel defined by the respective handle 12 and engages the magnet 50 or the magnet carrier 52 as shown in FIG. 9. In this regard, the finger of the spacer may be configured to engage both a side surface and a top surface of the magnet or the magnet carrier, thereby effectively preventing the spacer from rotating.

Although described herein in the context of particular embodiments of a multipurpose tool, a wide variety of multipurpose tools may include one or more tool members that define a notch 58 in order to facilitate user accessibility For example, a multipurpose tool having a single handle may include one or more tool members that define a notch to permit the user to rotatably open the tool member(s) without having to utilize their fingernails.

The portion of the tool members that is exposed through the channel defined by the handles 12 when in a closed position may include a plurality of grooves 60 extending laterally across the plurality of shorter tool members. Although the grooves may extend across all of the tool members, the embodiment depicted in FIGS. 3A and 3B include grooves extending across the shorter tool members, but not the longer tool members. The grooves are spaced longitudinally in an aligned manner across the plurality of shorter tool members. The grooves provide a visible indication to a user as to where to press in order to apply the opening force to the tool members. In addition, the grooves provide some additional grip during use of the tool members.

As shown in FIGS. 8 and 10, the tool members also include respective cam members 62 and the multipurpose tool 10 includes a cam follower 64 configured to engage the cam members of the tool members so as to prevent inadvertent opening of the tool members and to require the user to provide increased rotational force to the tool members relative to the handles 12 in order to fully open the tool members. In an example embodiment, the multipurpose tool may include a single cam follower for engaging the cam member of each of the tool members rotatably mounted upon the axle 54 proximate the distal end 20 of a respective handle. However, as illustrated in FIGS. 10A and 10B with respect to shorter tool members 61 and longer tool members 63, the cam members of the tool members mounted upon the axle may be different from one another so as to differently interact with the cam follower during rotation of the tool members from the closed position to the open position. Regardless of the length of the tool members, the cam member has a curved cam surface 66 configured to interact with the cam follower. The curved cam surface of an example embodiment has a spiral shape such that the radius from the axle upon which the tool member is mounted to the cam surface increases, such as in a linear manner, in a circumferential direction about the cam surface. In this regard, the radius defined by the cam surface may increase from that portion of the cam surface that the cam follower is proximate when the tool member is in the fully closed position to that portion of the cam surface that the cam follower is proximate as the tool member approaches the fully open position.

Figure 12A:
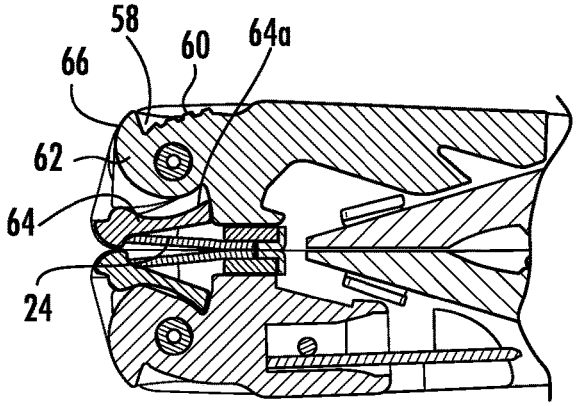
Figure 12B:
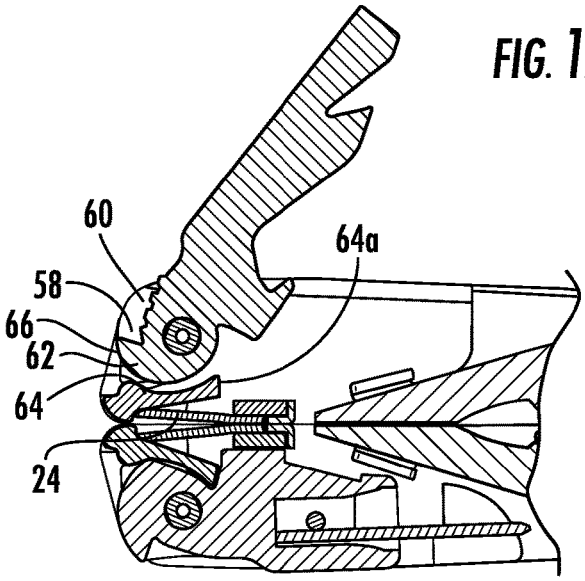
Figure 12C:
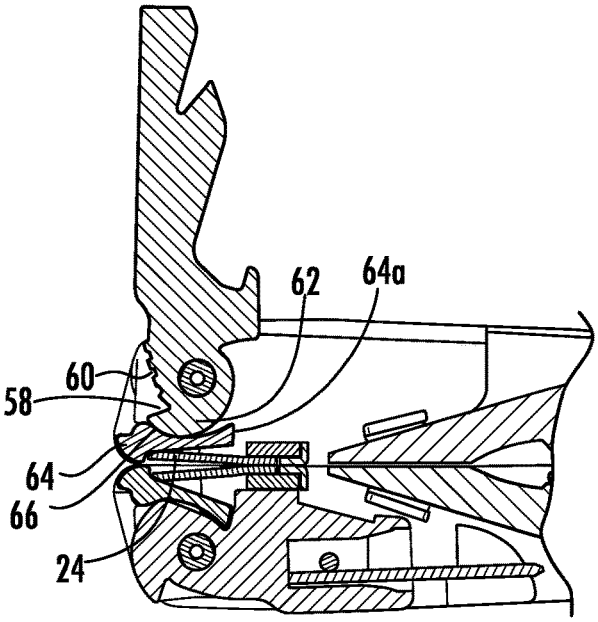
Figure 12D:
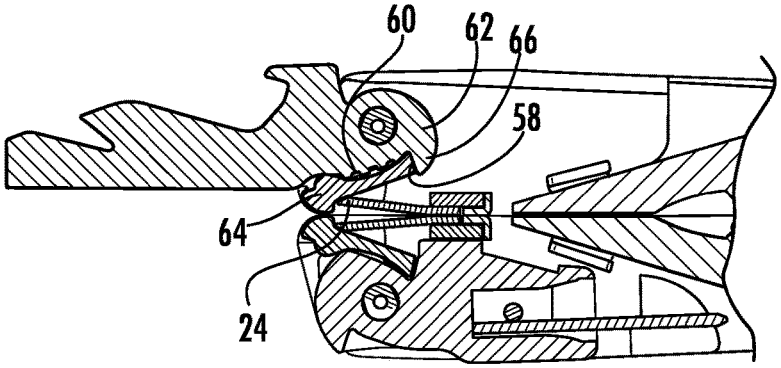

As shown in FIGS. 11A-11C, the cam follower 64 is configured to engage the cam member 62 of the longer tool members 63 while the longer tool member is in the closed position as shown in FIG. 11A, throughout the entire process of opening the longer tool member as shown in FIG. 11B and when the longer tool member is in the open position as shown in FIG. 11C. Thus, the continuous engagement of the cam follower with the cam member of longer tool member provides at least some resistance to the opening of the longer tool member in order to avoid its inadvertent opening. In contrast, the cam member 62 of the shorter tool members 61 of this example embodiment is configured such that the cam follower 64 does not engage and, indeed, is spaced from the cam surface 66 as the tool member rotates from a fully closed position to a first incidence angle at which the cam follower initially engages the cam surface. See, for example, FIGS. 12A and 12B which illustrate lack of engagement and the space between the cam surface and the cam follower as the shorter tool member is opened from a closed position to an angle that is less than the first incidence angle. Thus, the cam follower does not bias or otherwise limit the initial rotation of the shorter tool member from the closed position up to the first incidence angle. The first incidence angle of an example embodiment is less than 90°, such as between about 300 and 80°, although the cam surface may be configured to define different incidence angles in other embodiments. The multipurpose tool 10 may be configured to prevent the engagement of the cam follower and the cam surface of the shorter tool members until the shorter tool members have been opened by at least the first incidence angle in various manners, such as described below. Once the shorter tool member opens to the first incidence angle, the cam follower engages the cam surface and rides thereupon, as shown in FIGS. 12C and 12D in which the shorter tool member is further opened to the open position. The cam follower is biased, such as by a spring member 24, into engagement with the cam surface so as to resist further opening of the tool member and to require the user to apply increased rotational force to fully open the tool member, thereby avoiding inadvertent opening of the tool member.

As shown in FIG. 13, the cam follower 64 may be configured in various manners, but, in an example embodiment, the cam follower is a plate-like member rotatably mounted to an axle 68 proximate the distal end 20 of the handle 12. In this regard, the cam follower may be mounted upon an axle that is closer to the distal end of the handle than the axle 54 upon which the tool members are mounted. Additionally, the axle upon which the cam follower is mounted may be proximate the floor 16 of the handle or, at least, closer to the floor than the axle upon which the tool members are mounted. As such, the handle, such as the floor of the handle, may define the spring member 24 that urges the cam follower into engagement with the cam surfaces 66 of the tool members. In the illustrated embodiment, the floor of the handle includes a pair of spring members defined by slots formed in the floor of the handles with the spring members biased toward the cam follower so as to urge the cam follower toward the cam surfaces of the tool members.

In accordance with an example embodiment, the cam surfaces 66 of the tool members extend circumferentially about the cam member 62 and terminate with the notch 58 engaged by the user to open the tool members. Once the tool member is fully opened, the spring member 24 urges the cam follower 64 into the notch. As shown in FIG. 13, the spring member applies a force to the cam follower at a location between the axle 54 upon which the tool members are mounted and the axle 68 upon which the cam follower is pivotally mounted so as to urge the cam follower into the notch, thereby providing haptic feedback, e.g., tactile and/or auditory feedback, advising the user that the tool member is fully opened. The notch is at least partially defined by a wall member 70, such as a wall member that extends substantially radially outward from the axle 54. The distal end 64*a* of the cam follower is configured to abut the wall member of the notch, such as at a substantially perpendicular orientation, when the tool member is in the fully open position as a result of the force applied by the spring member to the cam follower. Thus, the tool member will reliably remain in the open position during use and will have substantial rigidity as a result of the mechanical interaction between the cam follower and the wall member that at least partially defines the notch. Further, interaction between the tool member and the cam follower proximate the axle upon which the cam follower is rotatably mounted provides a stop to further over-rotation of the tool member and further adds to the rigidity of the tool member during use. The cam follower therefore serves as the lock for each of the tool members mounted upon the axle.

In order to close the tool member, a user of the multipurpose tool 10 of this example embodiment is required to provide a force to the cam follower 64 that causes the spring member 24 to deflect and the cam follower to disengage the notch 58 defined by the cam surface 66. Once the cam follower has been disengaged from the notch, the tool member may be folded from the fully open position to a partially closed position and may then be further rotated to the fully closed position with haptic feedback again being provided to inform the user that the tool member is fully closed as a result of the tool member contacting a corresponding stop within the handle, such as the kick or foot of one or more of the tool members contacting the magnet carrier 52. In an example embodiment depicted in FIGS. 1 and 2, the handle 12 defines a slot 72 through an outer sidewall 14 and a lever 74 connected to the cam follower extends through this slot. Thus, a user may apply a force to the lever that displaces the spring member and causes the cam follower to be disengaged from the notch defined by the cam surface of the respective tool member such that the tool member may be folded from the fully opened position. Advantageously, the user may actuate the lever and close the tool member with one hand while keeping their hand outside of the path of travel of the tool member. The slot 72 of an example embodiment may be defined so as to limit the travel of the cam follower that would otherwise be caused by the spring member. In this regard, the slot may be defined so as to prevent the cam follower from being deflected by the spring member to such a degree that the cam follower contacts the cam surface of the shorter tool members until the shorter tool members have been rotatably opened to at least the first incidence angle.

Although the cam follower 64 does not engage the cam surfaces 66 of the shorter tool members 61 until the shorter tool members have rotated through a first incidence angle, the magnetic forces applied by the first and second magnets 50 may also extend through the tool members and apply a bias force to the tool members to prevent the tool member from opening from the handle absent the application of an opening force by the user. Thus, the tool members cannot be freely opened even though the cam follower does not immediately engage the cam surfaces of the shorter tool members, but instead, an opening force must be applied to the tool members by the user so as to overcome the magnetic force. As described above with respect to the opening with the handles, the magnetic force applied by the magnets significantly dissipates after the tool members have been opened to some degree, such as to about the first incidence angle. Thus, the opening of the tool members, such as the shorter tool members, requires the user to overcome a combination of the magnetic forces provided by the magnets carried by the handles and the bias force provided by a cam follower which engages the cam surfaces of the tool members with the user initially needing to overcome the magnetic forces provided by the magnets and then needing to overcome the bias force provided by the interaction of the cam follower with the cam surfaces of the tool members once the tool members have opened to about the first incidence angle.

As noted above, the interaction between the cam follower 64 and the cam surfaces 66 of the tool members may differ from one tool member to another. In this example embodiment, the longer tool members may include cam members 62 having cam surfaces that are differently configured than the cam surfaces of the shorter tool members. In this regard, the cam surfaces of the longer tool members may be configured to also have a spiral shape in which the radius from the axle 54 about which the tool members rotate to the cam surfaces increases in a circumferential direction from the portion of the cam surface with which the cam follower is aligned when the tool member is in the closed position to the portion of the cam surface engaged by the cam follower when the tool member is in a fully open position. However, the cam surfaces of the longer tool members of this example embodiment are configured such that the cam follower engages the cam surfaces upon rotation of the longer tool members through a second incidence angle, different than the first incidence angle, such as by being less than the first incidence angle. For example, the second incidence angle may be 0° such that the cam follower initially engages the cam surfaces of the longer tool members while the longer tool members are in the closed position and then continues to engage the cam surfaces as the longer tool members are rotated from the closed position to the open position with the cam follower providing increased bias force as a result of the ever-increasing radius of the cam surface thus, the user must provide increased opening forces to fully open the tool member. See, for example, FIGS. 11A-11C.

The longer tool members may include tool members that have longer cutting edges than the shorter tool members. Thus, the cam surfaces 66 of longer tool members may be configured to require the user to apply more force in order to initially open the longer tool members than the shorter tool members so as to provide even greater resistance to inadvertent opening of the longer tool members, particularly in instances in which the magnets 50 may have been removed from the multipurpose tool 10. Like the shorter tool members, the longer tool members may be locked in the fully open position and may have significant rigidity as a result of the manner in which the cam follower engages the notch 58 defined by the cam surfaces of the longer tool members. Further, the longer tool members may be unlocked and folded into the closed position in a comparable manner to that described above with respect to the shorter tool members.

As a result of the manner in which the cam follower 64 engages the cam surfaces 66 of the tool members, the shorter tool members having cam members 62 are not initially engaged by the cam follower may more readily open, such as in a clump, in response to an opening force applied by the user, such as by sliding your thumb toward the distal end 20 of the handle 12, while the longer tool members that have cam surfaces that are initially engaged by the cam follower may not open as readily and, in any event, may not open in a clump with the shorter tool members. However, the longer tool members are generally positioned within the side channels 56 proximate the outer sidewalls 14. Thus, the exterior sidewalls may define a cutout 76 to permit the user to engage the longer tool members and to apply an opening force thereto in a manner that is generally not available with respect to the shorter tool members positioned upon a central portion of the axle 54 between the longer tool members. See, for example, FIGS. 3A and 3B.

As noted above, the multipurpose tool 10 can include a variety of tool members. For example, one tool member may be a pair of scissors 80, as shown in FIGS. 14 and 15. The pair of scissors of an example embodiment may include an adjacent pair of blades that interact with one another in a scissors motion. The pair of scissors blades may be opened such that in the fully open position one of the blades, namely, a fixed blade 82, is locked in a fully open position and is fixed in position relative to the handle 12. The other blade, namely, the movable blade 84, is permitted to move relative to the fixed blade in order to provide the cutting motion. In order to actuate the scissors in the absence of handles, the user generally places one finger under the fixed blade, such as along the back surface of the fixed blade and another finger, such as the thumb of the user, on the back surface of the movable blade. In order to facilitate the user's interaction with the scissor blades, the back surface of one or both of the blades may include a broader tab 86 in order to provide a larger surface area upon which the user may interact.

The movable blade 84 may be biased into an open position. Although a variety of different springs may be utilized, the spring 86 of one example has a generally U-shape with one leg of the u-shaped spring being somewhat longer and mounted upon the axle 54 and the other leg of the U-shaped spring being offset laterally therefrom so as to engage a rear portion of the moveable blade. The spring is configured to apply a bias force to the movable blade so as to cause the movable blade to open relative to the fixed blade 82.

The movable and fixed scissors blades 84, 82 may interact with one another so as to limit the relative movement therebetween. In this regard, one of the scissors blades, such as the movable blade, may define a recessed track 85, while the other scissors blade, such as the fixed blade, may include a pin 87 or other protuberance that is seated within and engages the recessed track. To facilitate the relative movement between the scissors blades, the recessed track may have an arcuate shape and the pin may ride therewithin during movement of the scissors blades between the open and close position. However, the interaction between the pin and recessed track, such as the limits imposed upon the movement of the pin and, therefore, the relative movement of the scissors blades by the opposed ends of the recessed track, prevents the scissors blades from closing too completely or from opening too far.

Another tool member is configured to alternately hold a knife blade 90, such as an X-Acto™ knife blade, and a screwdriver 92, such as an eyeglasses screwdriver, as shown in FIG. 16. As illustrated in FIG. 17, the tool member defines an internal cavity and a slot 94 opening through an end surface of the tool member and into the internal cavity. The slot is sized and shaped so as to receive a knife blade. In order to retain the knife blade within the tool member during use, the tool member defines a spring 96, such as a U-shaped spring that engages the knife blade, such as a corresponding recess defined by the knife blade, once the knife blade has been inserted therein. In order to disengage the knife blade and to permit the knife blade to be removed from the tool member, the spring may be deflected and the knife blade may be removed. In an example embodiment, the spring member may be defined by a plate 98, such as a relatively thin metal plate that defines at least a portion of the internal cavity of the tool member. Like the tool member, the plate is rotatably mounted upon the axle 54 carried by the distal end 20 of the handle 12, but is able to be deflected by a user who applies a deflection to the portion of the plate proximate the spring member that engages the knife blade. Upon removal of the knife blade and removal of the deflection force by the user, the plate returns to its undeflected position and is configured to engage another knife blade.

The tool member of this example embodiment is configured such that the slot 94 defined by the tool member includes an enlarged portion 100. The enlarged portion has a profile that matches the profile of a screwdriver 92. In an example embodiment, the screwdriver may have a hexagonal shape, such as a squashed hexagonal shape, and the enlarged portion of the slot may define a correspondingly sized and shaped hexagonal opening, such as a squashed hexagonal opening, for snuggly receiving the screwdriver bit. Thus, the same tool member may alternately receive and engage a knife blade 90 and a screwdriver bit in order to further increase the utility afforded by the multipurpose tool 10.

As shown in FIGS. 18 and 19, another tool member may be a bit driver 102 in which the tool member defines a cavity in which one or more differently sized and shaped bit members 104 may be inserted and retained. In order to retain the bit members, the tool member includes a spring 106 configured to engage the bit members upon insertion into the cavity defined by the tool member. In this embodiment depicted in FIG. 17, the bit member includes a shaft that defines a notch 108 along at least one side thereof. The spring is biased into engagement with the notch defined by the shaft of the bit so as to securely retain the bit within the tool member. The user is then required to apply a disengagement force to displace the spring from the notch in order to permit the bit to be removed from the tool member and replaced, for example, with a different bit.

The spring 106 of an example embodiment is a U-shaped spring member that extends along one side of the tool member and includes an end portion 106*a* that is bent inward toward the bit member so as to engage the notch defined thereby. In order to prevent or at least reduce deflection of the spring member, such as in a lateral or side-to-side direction relative to the elongate length of the spring member, the tool member of this example embodiment depicted in FIGS. 18 and 19 may include a support member 110 that is aligned with the elongate opening defined by the U-shaped spring and is seated therewithin such that any lateral deflection of the U-shaped spring causes contact with the support member which prevents or least limits such deflection and correspondingly reducing the fatigue of the spring otherwise caused by such deflection. Thus, the spring may more securely retain the bit member within the tool member while still permitting controlled removal and replacement of the bit member.

Figure 20A:
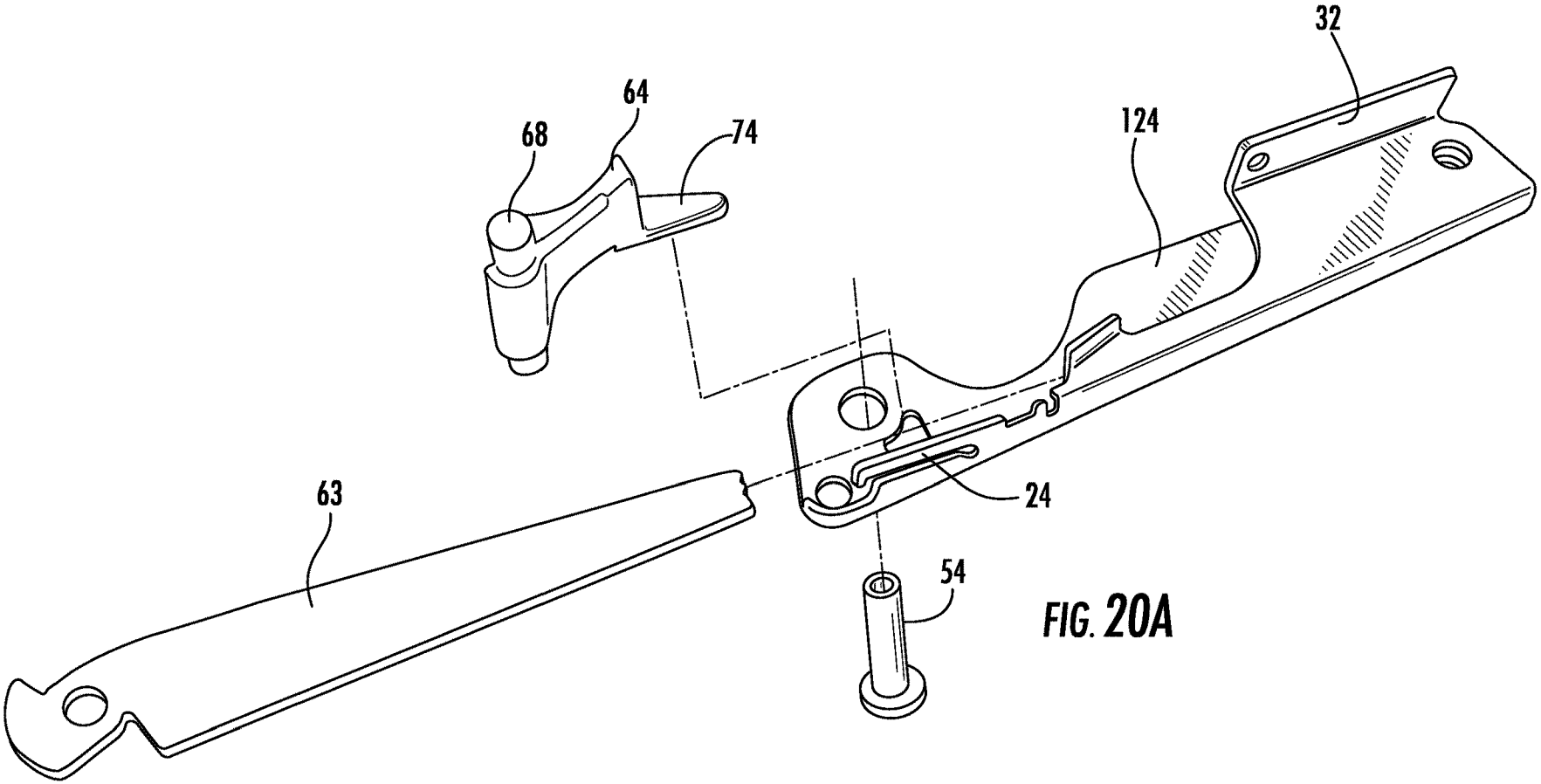
Figure 20B:
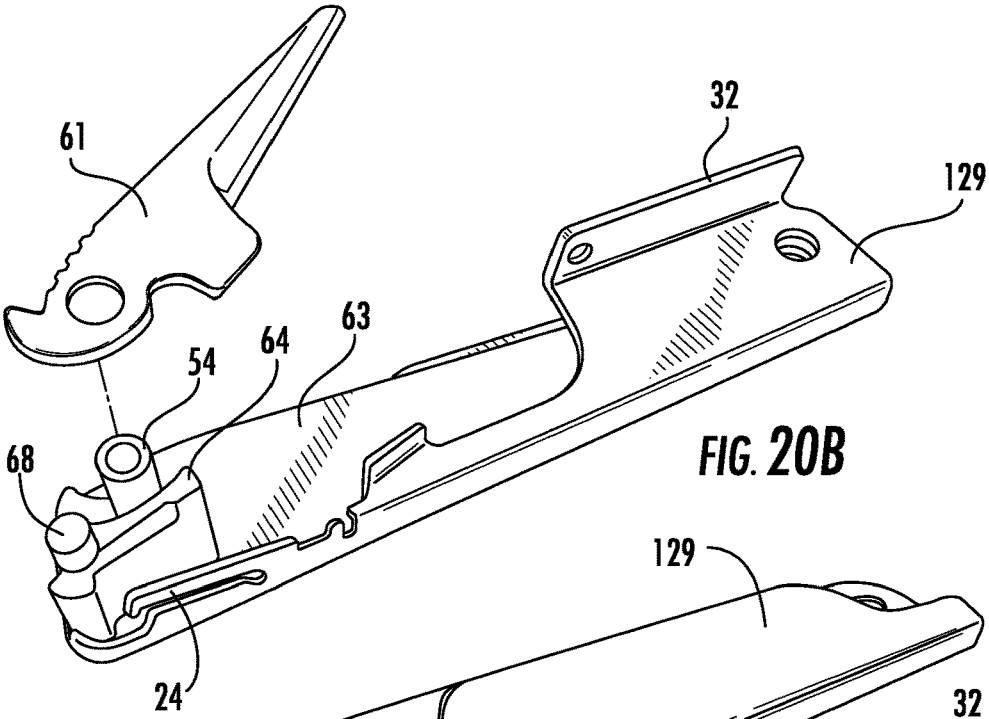
Figure 20C:
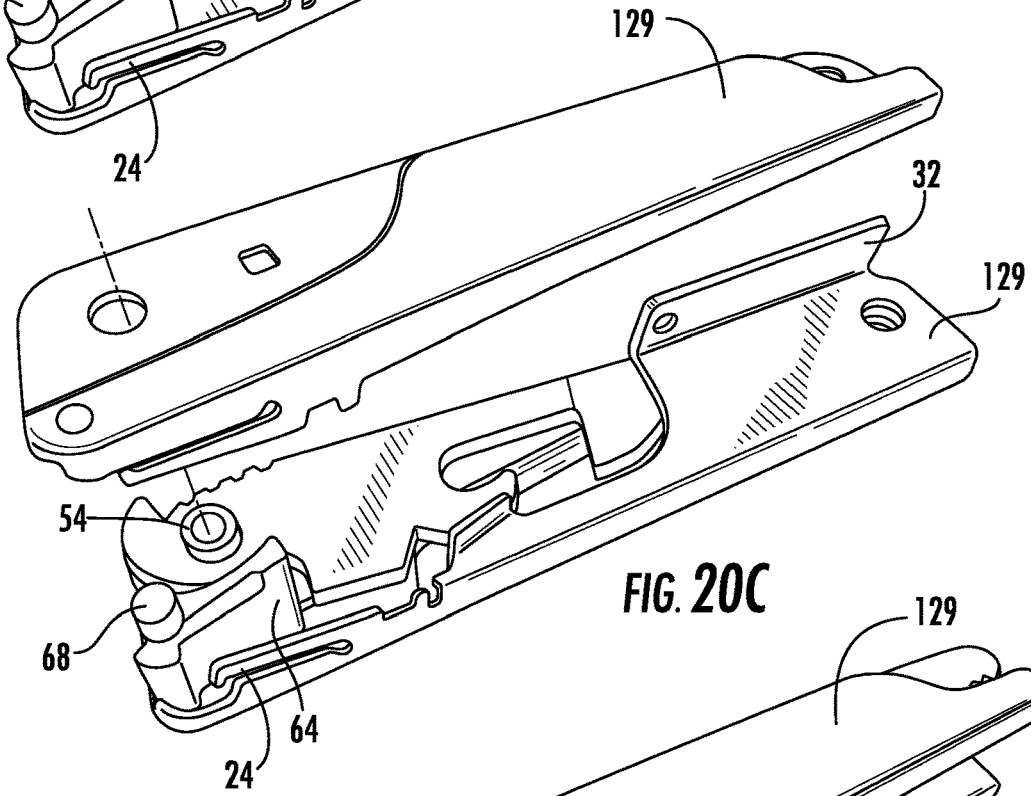
Figure 20D:
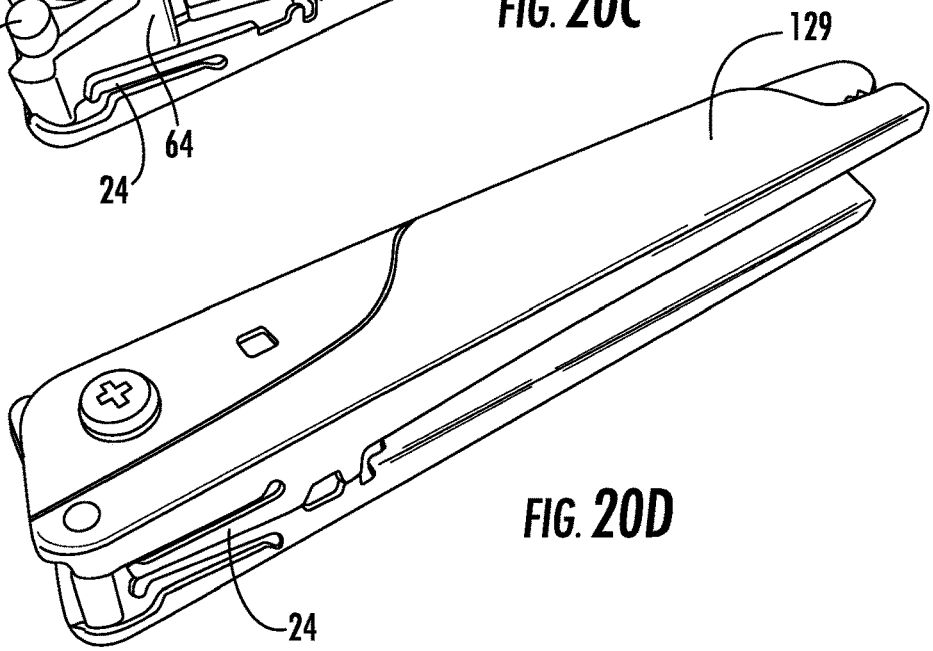

The multipurpose tool 10 may be assembled in various manners. In an example embodiment, however, each handle 12 is formed of a plurality of handle portions 12*a*, such as a pair of handle portions as described above. In this example embodiment, a handle portion may be positioned such that the outer sidewall 14 lays flat upon a surface, such as a table or desk. An axle 54 may be positioned through a corresponding opening defined by the outer sidewall so as to extend upwardly therefrom and one or more tool members may then be stacked upon the axle. In the example described above, a longer tool member 63 may be positioned upon the axle adjacent the outer sidewall so as to extend through the side channels 56 defined by the W-shaped portion of the handle, as shown in FIG. 20A. The cam follower 64 and associated lever 74 may also be rotatably mounted to the handle portion 12*a*. Thereafter, one or more shorter tool members 61 may be mounted upon the axle 54 as shown in FIG. 20B. In order to increase the flexibility with which the tool members may be assembled, the tool members are uniform so as to be actuated and unlocked in an equivalent manner by either the right hand or the left hand of the user, thereby avoiding issues related to the handedness of the tool members. Once the desired tools have been stacked upon the axle, the other handle portion may be mounted upon the stacked tools as shown in FIG. 20C. Another longer tool member may then be mounted upon the axle so as to extend through the side channel defined by the other handle portion and the axle may be mechanically connected so as to be retained by the handle, as shown in FIG. 20D. In addition, the handle portions may be joined, such as by a rivet 33 through the interconnecting webs 32 of the W-shaped portion of the handle. In this regard, the same rivet may also mechanically attach the spring 44 to the interconnecting webs.

A jaw 34 may also be positioned within the channel defined by the handle 12 and the cam member 38 of the jaw may be positioned between the intermediate sidewalls 30 with a hub 41 extending between the intermediate sidewalls and through an opening defined by the cam member of the jaw. The jaws carried by a pair of handles may then be rotatably connected at the pivot point 36 to complete the assembly of a multipurpose tool 10.

By assembling the multipurpose tool 10 in this manner, the tool members may be mounted upon the axle 54 in a more controlled and systematic fashion. In addition, a user or supplier may customize the tool members or the relative location of the tool members included within the resulting multipurpose tool. To facilitate this configuration, each tool member may have the same thickness. Alternatively, the tool members may have different thickness selected from among a set of predetermined thicknesses, such as in increments of 0.02 inches or 0.04 inches. In this embodiment, the multipurpose tool may also include spacers configured to be mounted upon the axle with the spacers having a predefined thickness that offsets or accommodates any differences in the thicknesses of the tool members such that the tool members can be readily stacked upon the axle with the longer tool members aligned with the side channels 56 defined by the W-shaped portion of the handle 12 and the shorter tool members aligned within the medial portion of the channel. For example, non-rotating spacers 59 may be disposed between the longer tool members and the shorter tool members as shown in FIGS. 3A and 3B in order to isolate the tool members.

Although the handle 12 may be formed of two handle portions 12*a* that are substantially mirror images of one another, the handle of an example embodiment may be further customized by the inclusion of different handle portions. For example, in an instance in which the multipurpose tool 10 need not include as many of the longer tool members, each handle may include a first handle portion as described above so as to define a side channel 56 and a second handle portion that only includes a sidewall that extends the length of the handle and an interconnecting web 30 extending outwardly therefrom. Therefore, the second handle portion does not define a side channel and the resulting multipurpose tool is thinner as a result of its inclusion of two side channels for housing longer tool members as opposed to the four side channels for housing longer tool members as illustrated and described above. In still other embodiments in which the multipurpose tool does not include any of the longer tool members, neither handle portion includes a side channel.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. A multipurpose tool comprising:

a handle defining a channel, wherein the handle comprises an axle; and a plurality of tool members rotatably mounted upon the axle so as to be foldable into the channel defined by the handle, wherein at least some of the plurality of tool members define a notch extending in a lateral direction extending between the opposed sidewalls of the handle, wherein the notch is exposed in an instance in which the tool members are folded into the channel and is configured to be engaged by a user in order to at least partially rotatably open one or more of the tool members relative to the handle, wherein the plurality of tool members comprise at least one first tool member and a plurality of second tool members, wherein the at least one first tool member is longer than the plurality of second tool members, wherein the multipurpose tool further comprises a spacer positioned between the at least one first tool member and the plurality of second tool members with the spacer extending in a longitudinal direction through a portion of the channel without extending beyond the plurality of second tool members in the longitudinal direction such that the spacer is shorter in the longitudinal direction than the plurality of second tool members, wherein the plurality of second tool members are positioned in an adjacent relationship without a spacer therebetween, and wherein the spacer is mounted upon the axle and comprises a finger that extends into the channel and is engaged so as to prevent rotation of the spacer.

2. A multipurpose tool according to claim 1 wherein the plurality of tool members comprise first and second tool members, each of which includes a cam member, wherein the multipurpose tool further comprises a cam follower configured to engage the cam member of each of the first and second tool members during rotation of the first and second tool members relative to the first handle.

3. A multipurpose tool according to claim 2 wherein the cam member of the first tool member is different than the cam member of the second tool member such that the cam follower engages the cam member of the first tool member during opening of the first tool member upon rotation of the first tool member through a first incidence angle relative to the first handle and the cam follower engages the cam member of the second tool member during opening of the second tool member following rotation of the second tool member through a second incidence angle, different than the first incidence angle, relative to the first handle.

4. A multipurpose tool according to claim 3 wherein the cam follower engages the cam member of the first tool member upon opening of the first tool member and the cam follower does not engage the cam member of the second tool member upon opening of the second tool member but only engages the cam member of the second tool member during opening of the second tool member after the second tool member has rotated through the second incidence angle, wherein the second incidence angle is greater than zero, and wherein the second tool member defines the notch.

5. A multipurpose tool according to claim 1 further comprising a magnet carried by the handle, wherein the magnet is positioned relative to the tool members such that the magnet establishes a magnetic force in a path that extends through one or more of the tool members so as to bias the one or more tool members into a closed position in which the one or more tool members are folded into the channel.

6. A multipurpose tool according to claim 1 wherein the spacer comprises a non-rotating spacer positioned between the first and second tool members.

7. A multipurpose tool according to claim 1 wherein at least some of the tool members also define a plurality of grooves extending in the lateral direction between the opposed sidewalls of the handle, and wherein the plurality of grooves are exposed in an instance in which the tool members are folded into the channel.

8. A multipurpose tool comprising:

first and second handles configured for relative movement between a closed position and an open position, wherein each handle extends from a proximal end to a longitudinally opposed distal end, wherein each handle pivots about the proximal end to transition between the closed and open positions, and wherein the distal ends of the first and second handles separate from one another as the first and second handles transition from the closed position to the open position;

a plurality of tool members, wherein one or more of the plurality of tool members are carried by and foldable into the first handle and one or more of the plurality of tool members are carried by and foldable into the second handle;

a first magnet carried by the first handle, wherein the first magnet is configured to exert a magnetic force that biases the first and second handles into the closed position; and a second magnet carried by the second handle and aligned with the first magnet in an instance in which the first and second handles are in the closed position, wherein the first and second magnets are spaced apart from one another while the first and second handles are in the closed position such that the magnetic force is directed in a flux path that extends through at least one of the first handle, the second handle or one or more of the tool members, and wherein the first and second magnets are spaced between 5% and 25% of a length of the first and second handles, as measured between the proximal and distal ends of the first and second handles, from the distal ends of the first and second handles so as to be closer to the distal ends of the first and second handles than the proximal ends of the first and second handles.

9. A multipurpose tool according to claim 8 wherein the first magnet is positioned relative to the tool members such that the first magnet establishes the magnetic force in a path that extends through one or more of the tool members so as to bias the one or more tool members into a closed position in which the one or more tool members are folded into a respective handle.

10. A multipurpose tool according to claim 8 wherein the first handle comprises an axle upon which a plurality of the tool members are rotatably mounted, wherein the plurality of tool members comprise first and second tool members, each of which includes a cam member, wherein the multipurpose tool further comprises a cam follower configured to engage the cam member of each of the first and second tool members during rotation of the first and second tool members relative to the first handle.

11. A multipurpose tool according to claim 10 wherein the cam member of the first tool member is different than the cam member of the second tool member such that the cam follower engages the cam member of the first tool member during opening of the first tool member upon rotation of the first tool member through a first incidence angle relative to the first handle and the cam follower engages the cam member of the second tool member during opening of the second tool member following rotation of the second tool member through a second incidence angle, different than the first incidence angle, relative to the first handle.

12. A multipurpose tool according to claim 11 wherein the cam follower engages the cam member of the first tool member upon opening of the first tool member and the cam follower does not engage the cam member of the second tool member upon opening of the second tool member but only engages the cam member of the second tool member during opening of the second tool member after the second tool member has rotated through the second incidence angle, wherein the second incidence angle is greater than zero.

13. A multipurpose tool according to claim 8 further comprising:

first and second jaws rotatably connected to the first and second handles, respectively, wherein each jaw comprises a wall member; and first and second spring members configured to engage the wall members of the first and second jaws, respectively, wherein the wall member of each jaw has a thickness that varies such that the first and second spring members engage thicker portions of the wall members of the first and second jaws, respectively, as the first and second handles are rotated from the closed position to the open position.

14. A multipurpose tool according to claim 13 wherein the first and second handles each comprise opposed sidewalls, and wherein the first and second spring members are configured to provide a spring force to the wall members of the first and second jaws, respectively, that is directed through one of the sidewalls.

15. A multipurpose tool according to claim 8 wherein a respective tool member defines a slot that includes an enlarged portion, wherein the respective tool member is configured to alternately receive a knife blade within the slot or a screwdriver within the enlarged portion of the slot.

16. A multipurpose tool according to claim 8 further comprising first and second carriers in which the first and second magnets, respectively, are disposed, wherein the first and second carriers are mounted within the first and second handles, respectively by a mechanical attachment to a respective handle or an interference fit within the respective handle.

17. A multipurpose tool comprising:

first and second handles configured for relative movement between a closed position and an open position, wherein each handle extends from a proximal end to a longitudinally opposed distal end, wherein each handle pivots about the proximal end to transition between the closed and open positions, and wherein the distal ends of the first and second handles separate from one another as the first and second handles transition from the closed position to the open position;

a plurality of tool members, wherein one or more of the plurality of tool members are carried by and foldable into the first handle and one or more of the plurality of tool members are carried by and foldable into the second handle; and a first magnet carried by the first handle and positioned relative to the tool members such that the first magnet establishes a magnetic force in a path that extends through at least one tool member carried by the first handle so as to bias the at least one tool member toward a closed position in which the at least one tool member is folded into the first handle, wherein the first magnet is spaced between 5% and 25% of a length of the first handle, as measured between the proximal and distal ends of the first handle, from the distal end of the first handle so as to be closer to the distal end of the first handle than the proximal end of the first handle, and wherein the first magnet is disposed within the first handle such that the first magnet remains spaced from the second handle in an instance in which the first and second handles are in the closed position.

18. A multipurpose tool according to claim 17 further comprising a second magnet carried by the second handle and aligned with the first magnet in an instance in which the first and second handles are in the closed position, wherein the first and second magnets are configured to bias the first and second handles into the closed position.

19. A multipurpose tool according to claim 17 wherein the first handle comprises an axle upon which a plurality of the tool members are rotatably mounted, wherein the plurality of tool members comprise first and second tool members, each of which includes a cam member, wherein the multipurpose tool further comprises a cam follower configured to engage the cam member of each of the first and second tool members during rotation of the first and second tool members relative to the first handle.

20. A multipurpose tool according to claim 19 wherein the cam member of the first tool member is different than the cam member of the second tool member such that the cam follower engages the cam member of the first tool member during opening of the first tool member upon rotation of the first tool member through a first incidence angle relative to the first handle and the cam follower engages the cam member of the second tool member during opening of the second tool member following rotation of the second tool member through a second incidence angle, different than the first incidence angle, relative to the first handle.

21. A multipurpose tool according to claim 20 wherein the cam follower engages the cam member of the first tool member upon opening of the first tool member and the cam follower does not engage the cam member of the second tool member upon opening of the second tool member but only engages the cam member of the second tool member during opening of the second tool member after the second tool member has rotated through the second incidence angle, wherein the second incidence angle is greater than zero.

22. A multipurpose tool according to claim 17 further comprising:

first and second jaws rotatably connected to the first and second handles, respectively, wherein each jaw comprises a wall member; and first and second spring members configured to engage the wall members of the first and second jaws, respectively, wherein the wall member of each jaw has a thickness that varies such that the first and second spring members engage thicker portions of the wall members of the first and second jaws, respectively, as the first and second handles are rotated from the closed position to the open position.

23. A multipurpose tool according to claim 22 wherein the first and second handles each comprise opposed sidewalls, and wherein the first and second spring members are configured to provide a spring force to the wall members of the first and second jaws, respectively, that is directed through one of the sidewalls.

24. A multipurpose tool according to claim 17 further comprising a first carrier in which the first magnet is disposed, wherein the first carrier is mounted within the first handle by a mechanical attachment to the first handle or an interference fit within the first handle.

25. A multipurpose tool comprising:

first and second handles configured for relative movement between a closed position and an open position;

a plurality of tool members carried by and foldable into the first handle, wherein the first handle comprises an axle upon which the plurality of tool members are rotatably mounted, wherein the plurality of tool members comprise first and second tool members, each of which includes a cam member; and a cam follower configured to engage the cam member of each of the first and second tool members during rotation of the first and second tool members relative to the first handle, wherein the cam member of the first tool member is different than the cam member of the second tool member such that the cam follower is configured to initially engage the cam member of the first tool member while the first tool member is in a closed position and is also configured to remain continuously engaged with the cam member of the first tool member throughout the opening of the first tool member, wherein the cam follower is configured to be spaced from and not to engage the second tool member (i) while the plurality of tool members including the second tool member are in the closed position and (ii) while the second tool member is rotated through an incidence angle from the closed position and the cam follower is further configured to initially engage and thereafter ride upon the cam member of the second tool member as the second tool member is further rotated beyond the incidence angle to the open position.

26. A multipurpose tool according to claim 25 further comprising first and second magnets carried by the first and second handles, respectively, wherein the first and second magnets are aligned in an instance in which the first and second handles are in the closed position, and wherein the first and second magnets are configured to bias the first and second handles into the closed position.

27. A multipurpose tool according to claim 25 further comprising:

first and second jaws rotatably connected to the first and second handles, respectively, wherein each jaw comprises a wall member; and first and second spring members configured to engage the wall members of the first and second jaws, respectively, wherein the wall member of each jaw has a thickness that varies such that the first and second spring members engage thicker portions of the wall members of the first and second jaws, respectively, as the first and second handles are rotated from the closed position to the open position.

28. A multipurpose tool according to claim 25 wherein the first tool member is longer than the second tool member.

* * * * *